US009714070B2

(12) United States Patent
Cruz Ricardez

(10) Patent No.: US 9,714,070 B2
(45) Date of Patent: Jul. 25, 2017

(54) FLOATATION DEVICE FOR USE IN WATER RECREATION

(71) Applicant: Waterblade, LLC, North Las Vegas, NV (US)

(72) Inventor: Gameli E. Cruz Ricardez, North Las Vegas, NV (US)

(73) Assignee: WATERBLADE, LLC, North Las Vegas, NV (US)

( * ) Notice: Subject to any disclaimer, the term of this patent is extended or adjusted under 35 U.S.C. 154(b) by 0 days.

(21) Appl. No.: 15/176,125

(22) Filed: Jun. 7, 2016

(65) Prior Publication Data

US 2016/0280340 A1 Sep. 29, 2016

Related U.S. Application Data

(63) Continuation of application No. 14/749,444, filed on Jun. 24, 2015, now Pat. No. 9,399,502, which is a continuation-in-part of application No. 14/556,943, filed on Dec. 1, 2014, now abandoned.

(60) Provisional application No. 61/931,119, filed on Jan. 24, 2014.

(51) Int. Cl.

| | |
|---|---|
| ***B63B 35/79*** | (2006.01) |
| ***B63B 1/04*** | (2006.01) |
| ***B63H 5/125*** | (2006.01) |
| ***B63H 21/17*** | (2006.01) |
| ***B63H 23/24*** | (2006.01) |
| ***B63B 1/26*** | (2006.01) |
| ***B63H 21/21*** | (2006.01) |
| ***B63H 11/02*** | (2006.01) |
| *B63H 25/02* | (2006.01) |
| *B63H 11/08* | (2006.01) |

(52) U.S. Cl.

CPC ..... *B63B 35/7943* (2013.01); *B63B 1/04* (2013.01); *B63B 1/26* (2013.01); *B63B 35/7926* (2013.01); *B63H 5/125* (2013.01); *B63H 11/02* (2013.01); *B63H 21/17* (2013.01); *B63H 21/213* (2013.01); *B63H 23/24* (2013.01); *B63H 25/02* (2013.01); *B63H 2005/1258* (2013.01); *B63H 2011/081* (2013.01)

(58) Field of Classification Search

CPC ..... B63B 35/731; B63B 1/04
USPC ..... 441/129
See application file for complete search history.

(56) References Cited

U.S. PATENT DOCUMENTS

| | | | |
|---|---|---|---|
| 22,457 | A | 12/1858 | Rowlands |
| 3,552,349 | A | 1/1971 | Snow |
| 3,601,828 | A | 8/1971 | Fairchild |

(Continued)

OTHER PUBLICATIONS

European Search Report dated Apr. 21, 2016, for European Application No. 15173244.3 (7 p.).

*Primary Examiner* — Lars A Olson
*Assistant Examiner* — Jovon Hayes
(74) *Attorney, Agent, or Firm* — Conley Rose, P.C.

(57) ABSTRACT

A recreational water flotation device includes a central body defining an upper surface and a bottom surface and having a front end and a rear end. A left lateral element extends from a left end of the central body and defines a left canted surface canted toward the central body and further defines a left end of the flotation device. A right lateral element extends from a right end of the central body and defines a left canted surface canted toward the central body and further defining a right end of the flotation device. The device is buoyant in water. A propeller can be mounted to the bottom surface of the central body.

17 Claims, 17 Drawing Sheets

(56) References Cited

U.S. PATENT DOCUMENTS

| | | | | |
|---|---|---|---|---|
| 3,747,236 | A | 7/1973 | Sidlauskas | |
| 3,783,532 | A | 1/1974 | Harradine | |
| 3,808,622 | A | 5/1974 | Webster | |
| 4,060,866 | A | 12/1977 | Robinson | |
| 4,807,554 | A | 2/1989 | Chi-Hung | |
| 5,080,621 | A | 1/1992 | Nayes | |
| 5,429,537 | A | 7/1995 | Seith | |
| 5,544,607 | A * | 8/1996 | Rorabaugh | B60F 3/003 114/123 |
| 5,558,553 | A | 9/1996 | Okano | |
| D383,823 | S | 9/1997 | Grimes, Jr. | |
| 6,213,830 | B1 | 4/2001 | Robinson | |
| 6,334,402 | B1 * | 1/2002 | Gilligan | B63B 7/082 114/345 |
| 6,386,932 | B1 * | 5/2002 | Murphy | B63B 1/248 114/123 |
| 6,422,168 | B1 * | 7/2002 | Kobayashi | B63B 1/20 114/291 |
| 6,880,475 | B1 * | 4/2005 | Thompson | B63B 35/731 114/363 |
| 7,121,910 | B2 | 10/2006 | Rosen | |
| D552,204 | S | 10/2007 | Peterson | |
| 7,833,072 | B2 * | 11/2010 | Hsia | B63H 11/04 440/13 |
| 8,388,402 | B2 | 3/2013 | Fielding | |
| 8,789,484 | B2 * | 7/2014 | Donaldson | B63B 35/731 114/123 |
| 2006/0082089 | A1 | 4/2006 | Rejtano | |
| 2012/0302116 | A1 | 11/2012 | Chester | |

* cited by examiner

FLOATATION DEVICE FOR USE IN WATER RECREATION

CROSS-REFERENCE TO RELATED APPLICATIONS

This application is a continuation of U.S. application Ser. No. 14/749,444 filed Jun. 24, 2015 and entitled "Flotation Device for Use in Water Recreation," which claims the benefit of priority from U.S. application Ser. No. 14/556,943 filed Dec. 1, 2014 and entitled "Flotation Device for Use in Water Recreation," which in turn claims the benefit of priority from U.S. Provisional Application Ser. No. 61/931,119, filed Jan. 1, 2014, all of which are incorporated herein by reference in their entirety.

FIELD OF THE INVENTION

The present invention relates to a personalized recreational watercraft and method of use, and more particularly, to a watercraft offering stability and balance in both hydrostatic and hydrodynamic conditions.

BACKGROUND OF THE INVENTION

Conventional types of personalized watercraft like surf boards require the presence of moving water to balance the surf board while a user stands on it. Typical surf boards are designed for movement by waves, requiring hydrodynamic conditions to support the surf board and inhibit rotation. The surf board has a high tendency to rotate when a user stands on it in calm waters. Accordingly, in calm waters, the surf board will rotate when standing on it, leading to a loss of balance and an overturn of the surf board.

Accordingly, there remains a need in the art for a watercraft that offers stability and user balance when deployed in hydrostatic conditions, without compromising the effectiveness of the watercraft in hydrodynamic conditions.

SUMMARY OF THE INVENTION

The present invention overcomes the deficiencies of the known art and the problems that remain unsolved by providing a watercraft that features stability and balance in both hydrostatic and hydrodynamic conditions, and supports the capability of a user to self-propel the watercraft even in hydrostatic conditions.

Introducing a first embodiment of the invention, the present invention consists of a recreational water flotation device comprising a central body, a left lateral element and a right lateral element. The central body defines an upper surface and a bottom surface and has a front end and a rear end. The left lateral element extends from a left end of the central body, and defines a top, left canted surface that is canted toward the upper surface of the central body. The left lateral element further defines a left end of the flotation device. The right lateral element extends from a right end of the central body, and defines a top, right canted surface that is canted toward the upper surface of the central body. The right lateral element further defines a right end of the flotation device. The device is buoyant in water.

In a second aspect, the central body, the left lateral element and the right lateral element can form a single-piece body.

In another aspect, a left lateral side of the left lateral element and a right lateral side of the right lateral element can define a width of the flotation device, and the front end and rear end of the central body can define a length of the flotation device which is greater than the length.

In another aspect, the left lateral side and the right lateral side can have an arcuately convex peripheral shape, and the front end and the rear end of the central body can have an arcuately convex peripheral shape. In turn, peripheral areas connecting adjacent ones of the left lateral side, the front end, the right lateral side, and the rear end can be arcuately concave.

In another aspect, the recreational water flotation device can further include a left rear fin and a right rear fin, wherein the left and right rear fins can be arcuately concave and protrude from the bottom surface of the central body at a rear periphery thereof.

In another aspect, the recreational water flotation device can further include a front fin extending along a front edge of the central body and further extending between the left lateral element and the right lateral element, the front fin and the front edge defining a surface angled toward the rear end of the central body for providing a smooth flow of water thereover. [0012] In another aspect, the recreational water flotation device can further include a propulsion unit including a propeller arranged beneath the central body. [0013] In another aspect, the propeller can be rotatable with respect to the central body.

In another aspect, the propeller can be freely rotatable with respect to the central body.

In another aspect, the propeller can be limited to rotate within a predetermined angular range with respect to the central body.

In another aspect, the recreational water flotation device can further include a nonpropelling weight, wherein the propeller and the non-propelling weight can be interchangeably mountable to the central body.

In another aspect, the propeller can be electrically-driven, and the propulsion unit can further include a battery assembly for providing electrical power to the propeller. The battery assembly can be at least partially embedded in the central body.

In another aspect, at least one battery of the battery assembly can be removably insertable into the central body.

In another aspect, the propulsion unit can further include at least one user-operable control for starting and stopping the propeller. The at least one user-operable control can be operable by a user standing on the flotation device.

In another aspect, the propulsion unit can further include at least one user-operable control for adjusting the speed of the propeller. The at least one user-operable control can be operable by a user standing on the flotation device.

Introducing another embodiment of the invention, the present invention consists of a recreational water flotation device comprising a central body, a left lateral element and a right lateral element. The central body defines an upper surface and a bottom surface and has a front end and a rear end. The left lateral element extends from a left end of the central body and defines a left canted surface that is canted toward the central body. The left lateral element comprises a left lateral side defining a left end of the flotation device. The right lateral element extends from a right end of the central body and defines a right canted surface that is canted toward the central body. The right lateral element comprises a right lateral side defining a right end of the flotation device. The flotation device further includes a propulsion unit comprising a propeller arranged beneath the central body. The propeller is rotatable with respect to the central body. The device is buoyant in water.

Introducing yet another embodiment of the invention, the present invention consists of a recreational water flotation device comprising a central body, a left lateral element and a right lateral element. The central body defines an upper surface and a bottom surface and has an arcuately convex front end and an arcuately convex rear end. The left lateral element has a convexly arcuate left lateral side and extends from a left end of the central body. The left lateral element defines a left canted surface that is canted toward the central body, and further defines a left end of the flotation device. The right lateral element has a convexly arcuate right lateral side and extends from a right end of the central body. The right lateral element defines a right canted surface that is canted toward the central body, and further defines a right end of the flotation device. Peripheral areas connecting adjacent ones of the left lateral side, the front end, the right lateral side, and the rear end are arcuately concave. In addition, a front fin extends along at least a front edge of the central body, the front fin and the front edge defining a surface angled toward the rear for providing a smooth flow of water thereover. The floatation device further includes a left rear fin and a right rear fin, the left and right rear fins being arcuately concave and protruding from the bottom surface of the central body at a rear periphery thereof. In addition, the floatation device includes a propulsion unit comprising a propeller arranged beneath the central body, the propeller being rotatable with respect to the central body. The device is buoyant in water.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall be used to describe the invention in accordance with their common meaning. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
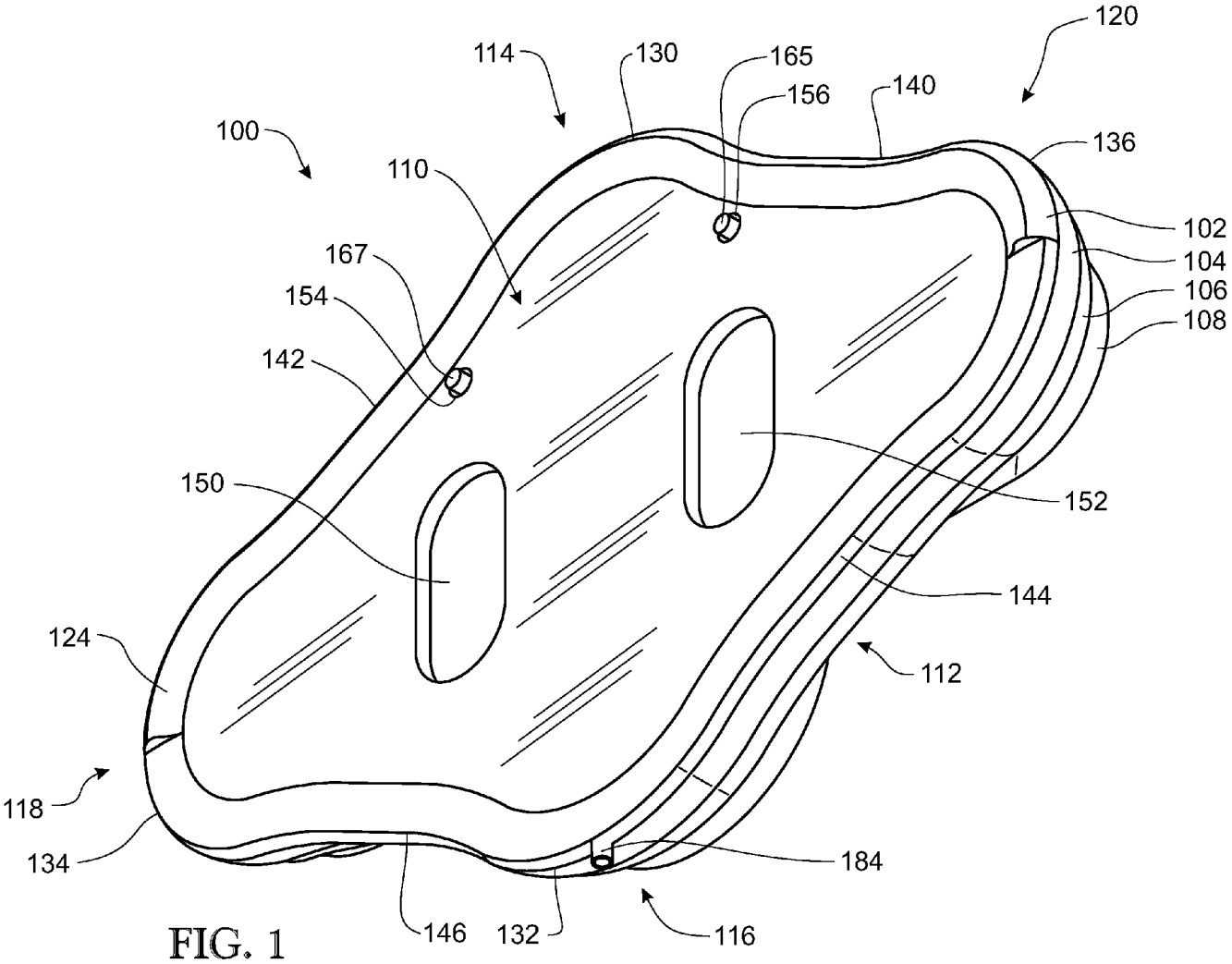
FIG. 1 presents an isometric top rear view of an exemplary floatation device, according to one implementation of the present invention.
Figure 2:
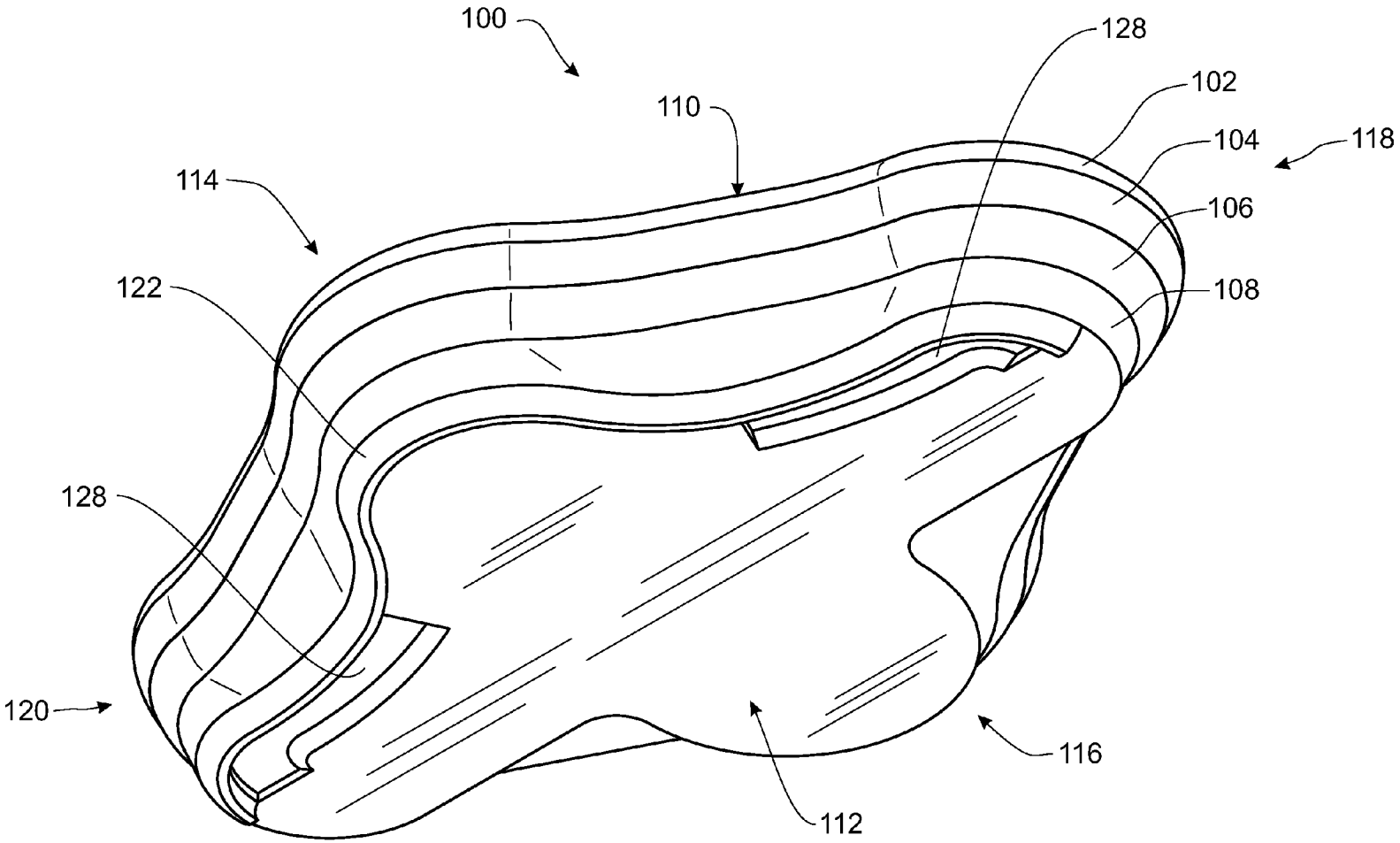
FIG. 2 presents an isometric bottom view of the floatation device originally introduced in FIG. 1.
Figure 3:
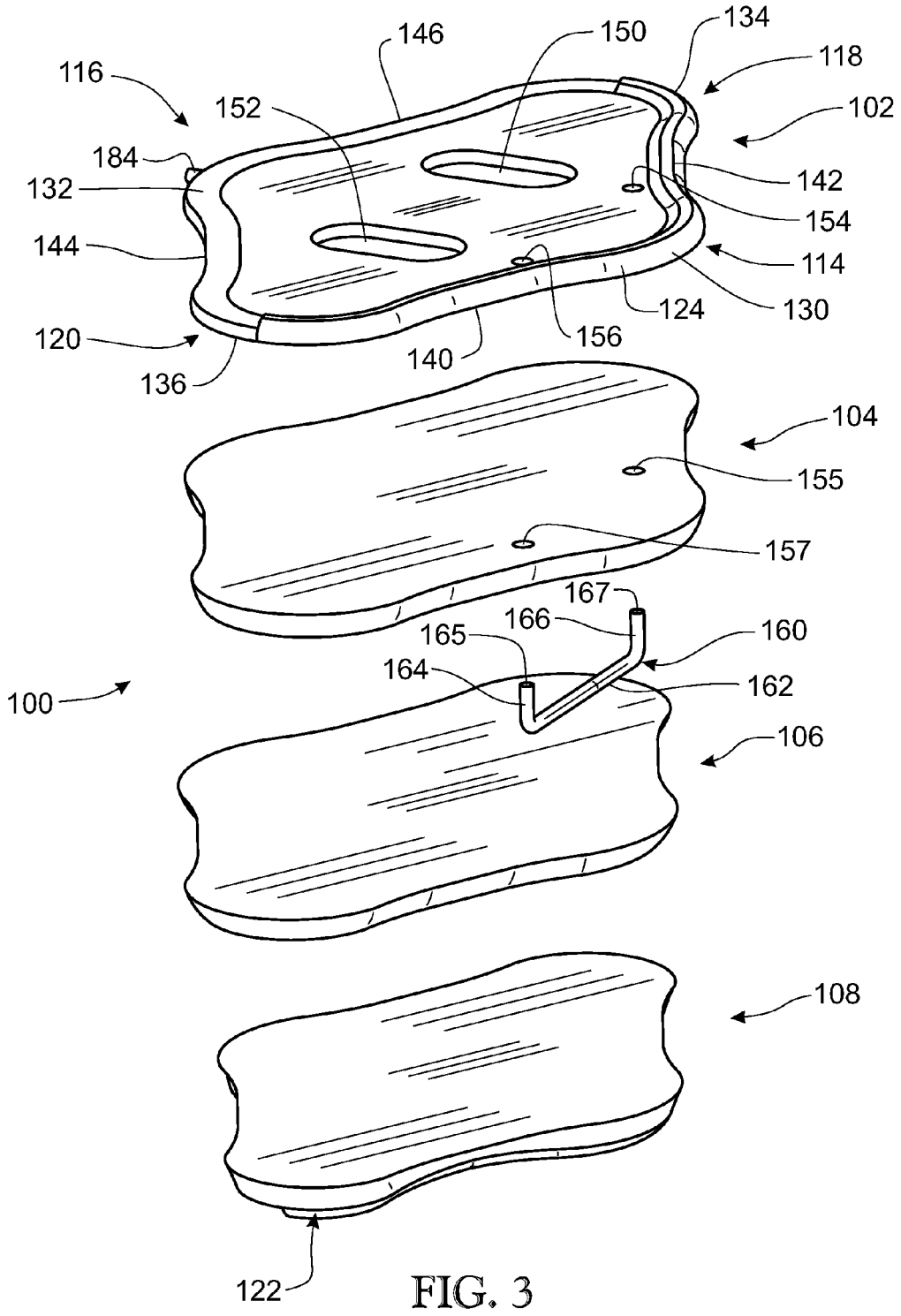
FIG. 3 presents an exploded view of the floatation device originally introduced in FIG. 1, demonstrating the individual layers that are stacked to form the composite assembly of the floatation device.
Figure 4:
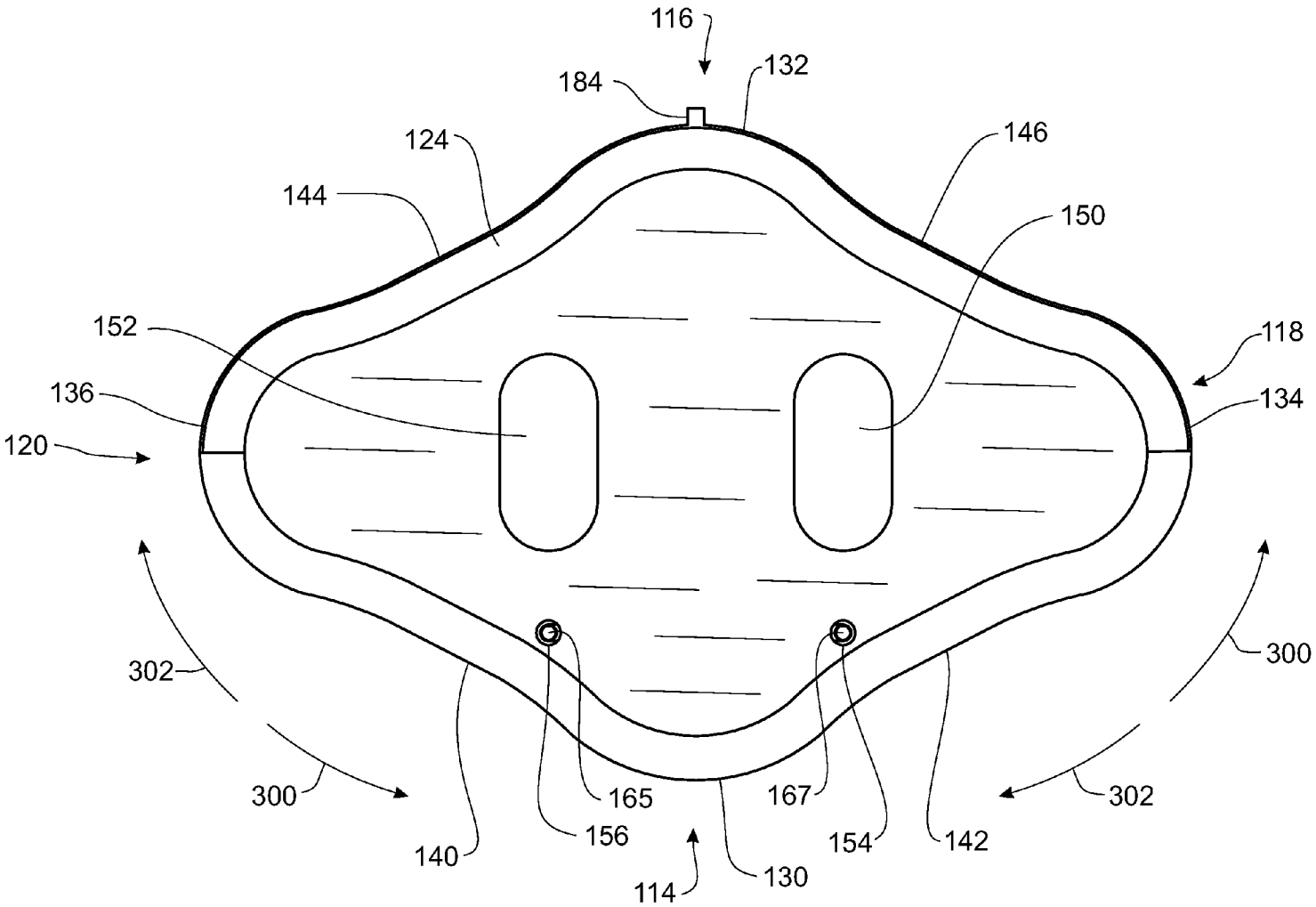
FIG. 4 presents a top view of the floatation device originally introduced in FIG. 1.

A floatation device 100 is presented in various configurations in the illustrations of FIGS. 1 through 4. The operation of the floatation device 100 by a user in a stand-up position is presented in FIGS. 5 and 6. The floatation device 100 of the present embodiment includes an assembly of individual layers that are attached together in a stacking arrangement to form a composite structure. In particular, as depicted in FIG. 3, the floatation device 100 includes an upper or top layer 102, a main body layer 104 disposed below the upper layer 102, a mid or intermediate layer 106 disposed below the main body layer 104, and a lower or bottom layer 108 disposed below the mid layer 106. The assembled form of floatation device 100 is depicted in the various views of FIGS. 1, 2 and 4. The floatation device 100 can generally be considered a watercraft or water vessel suitable for recreational purposes.

In its assembled form, floatation device 100 includes a dorsal or upper side 110 at upper layer 102, a ventral or lower side 112 at lower layer 108, a left lateral side 118, and a right lateral side 120. The dorsal side 110 defines a location where a user is situated in an operating position, such as a stand-up position while navigating the floatation device 100 through water. The user mounts and rides the floatation device 100 at the dorsal side 110. The ventral side 112 defines a location where the floatation device 100 is placed on or contacts the water. Floatation device 100 further includes a front, forward or anterior end 114 and a back, rearward or posterior end 116. The front end 114 serves as the nose section that defines the leading edge of floatation device 100 as the floatation device 100 travels through water. The rear end 116 serves as the tail section that defines the trailing edge of floatation device 100 as the floatation device 100 travels through the water. During operation, the user faces in the direction of the front end 114. The front end 114 and the rear end 116 define a longitudinal axis of the floatation device 100, while the left lateral side 118 and the right lateral side 120 define a lateral axis of the floatation device 100.

The assembled form of floatation device 100 has a generally diamond-shaped construction in plan view, preferably modified to include rounded vertices and curved sides. In an exemplary form, the floatation device 100 includes generally convex corners and generally concave sides. The floatation device 100 is preferably asymmetric along its longitudinal and lateral axes, such that the floatation device 100 is wider along its lateral (side-to-side) axis than along its longitudinal (front-to-back) axis. This asymmetry produces a generally oblong shape to the floatation device 100. One benefit of this axial asymmetry is that it produces a low turning moment about the longitudinal axis, resulting in a high resistance to rotation about the longitudinal axis. This asymmetry likewise produces a more stable platform or deck for the user to stand on and maneuver the floatation device 100. The geometry of the floatation device 100 is suitably chosen to present an underside surface area contacting the water that is sufficient to sustain the weight of an individual in water, while also inhibiting any rotation about the longitudinal axis to provide stability, especially in a resting (non-moving) state.

The floatation device 100 of the present embodiment has both hydrostatic and hydrodynamic flotation properties. At rest or in hydrostatic conditions, the floatation device 100 is very stable and permits the user to stand in an upright position without the risk of capsizing the floatation device 100. The asymmetry of floatation device 100 creates a very small turning moment about the longitudinal (front-to-back) axis, making it very difficult for the floatation device 100 to rotate about the longitudinal axis and capsize the floatation device 100. In hydrodynamic conditions, the floatation device 100 can readily move through water in a surfing style travel that rides along the water surface.

The exemplary shape and geometry of the floatation device 100 is implemented by a suitable construction of the individual layers 102, 104, 106, and 108. As depicted in FIG. 3, the exemplary upper layer 102 includes a front corner 130 disposed at the front end 114 of assembled floatation device 100, a rear corner 132 disposed at the rear end 116 of assembled floatation device 100, a left side corner 134 disposed at the left lateral side 118 of assembled floatation device 100, and a right side corner 136 disposed at the right lateral side 120 of assembled floatation device 100. The corners 130, 132, 134, and 136 are preferably rounded or curved in a convex shape. This convex geometry promotes flotation of the floatation device 100 and offers favorable resistance properties to facilitate ease of movement of the floatation device 100 through water. The convex corners 130, 132, 134, and 136 present reduced resistance and allow smooth water flow across the contours of the corners 130, 132, 134, and 136 as the floatation device 100 advances through the water.

The upper layer 102 further includes a front right edge or side 140 connecting the front corner 130 and the right side corner 136; a front left edge or side 142 connecting the front corner 130 and the left side corner 134; a right rear edge or side 144 connecting the rear corner 132 and the right side corner 136; and a left rear edge or side 146 connecting the rear corner 132 and the left side corner 134. The sides 140, 142, 144, and 146 are preferably curved in a concave shape. This concave geometry promotes smooth water flow along the periphery or boundary of floatation device 100 as the floatation device 100 travels through water.

The geometry and shape of the main body layer 104, the mid layer 106, and the lower layer 108 are similar to that of upper layer 102. Accordingly, once the upper layer 102, the main body layer 104, the mid layer 106, and the lower layer 108 are integrated together into a stacked configuration to produce the final assembled form of floatation device 100, the overall geometry of floatation device 100 is generally uniform throughout the layers 102, 104, 106, and 108. Various modifications to the geometry of the floatation device 100 can be made, however. For example, in order to promote greater hydrodynamic water flow at the front end 114 of floatation device 100, the layers 102, 104, 106, and 108 can be formed with progressively smaller sizes, while each still retains the same general shape. The upper layer 102 would have the largest size and the subsequent layers 104, 106, and 108 underneath it would be progressively smaller. The result would be a terraced-type profile. The scale factor used to create the different-sized layers 102, 104, 106, and 108 can be suitably selected to promote desired hydrodynamic flow patterns along and around the floatation device 100.

In an exemplary form, the lateral dimension extending between the left side corner 134 and the right side corner 136 is longer than the longitudinal dimension extending between the front corner 130 and the rear corner 132, producing an axial asymmetry that results in a generally oblong shape. The lateral and longitudinal dimensions can be adjusted to produce any type of oblong shape depending upon the hydrostatic and hydrodynamic properties that are desired. The combination of the front corner 130, rear corner 132, left side corner 134, and right side corner 136 can be collectively regarded as a set of vertices that define a generally diamondshaped configuration, modified to produce a selected type of axial asymmetry, if desired.

Each of the layers 102, 104, 106, and 108 is preferably formed of a rigid foam or heavy duty foam material conducive to flotation. An advantageous embodiment will have at least one layer manufactured using Expanded polystyrene (EPS) foam or Polyurethane foam. It should be apparent to those skilled in the art that any type of material can be used to construct layers 102, 104, 106, and 108 that is compatible with maintaining a flotation capability for floatation device 100. In an exemplary form, the floatation device 100 is constructed so that the upper layer 102 is made of a 1" (one inch) thick heavy duty EPS or Polyurethane foam layer; the main body layer 104 is made of a 2" (two inch) thick heavy duty EPS or Polyurethane foam layer; the mid layer 106 is made of a 2" (two inch) thick heavy duty EPS or Polyurethane foam layer; and the lower layer 108 is made of a 2" (two inch) thick heavy duty EPS or Polyurethane foam layer. These specific dimensions should not be considered in limitation of the invention but merely illustrative, as other dimensional values can be used to practice the invention. All of the layers 102, 104, 106, and 108 are glued together to produce the assembled form of floatation device 100. However, other bonding techniques are possible to attach the layers 102, 104, 106, and 108. The assembled structure of floatation device 100 is preferably processed with a finishing exterior coat of waterproofing to protect the foam material from cracking or moisture. This exterior coat can be a water-resistant epoxy resin material or fiberglass, for example. Alternative embodiments are contemplated in which the number of layers may vary. In some embodiments, the floatation device can be manufactured into a single-part block or unit. In other embodiments, the floatation device can include one or more inflatable portions or bladders that can be selectively inflated as desired by the user. In some embodiments, the floatation device can comprise a single, inflatable body that can be selectively inflated as desired by the user.

The floatation device 100 further includes a fin 122 attached to the bottom layer 108 at the front end 114 of floatation device 100, as best depicted in FIGS. 2 and 3. The fin 122 promotes guidance and maneuverability of the floatation device 100 through water. In addition, the fin 122 also provides an "oar" effect when moving the floatation device 100 backwards. This "oar" effect is enhanced by having the bottom layer 108 include two cut-outs 128 on its outer surface area, contiguous to the fin 122. The cut-outs 128 provide an increased total height of the rear wall of the fin 122 facing the cut-outs 128, contributing to the "oar" effect.

As best shown in FIG. 3, the upper layer 102 includes a trim or border 124 installed at the front or leading end 114 of floatation device 100, in order to add rigidity and to improve the ability of the floatation device 100 to cut through water. In an exemplary form, the trim 124 extends along the forward or anterior half of the perimeter of upper layer 102.

Figure 6:
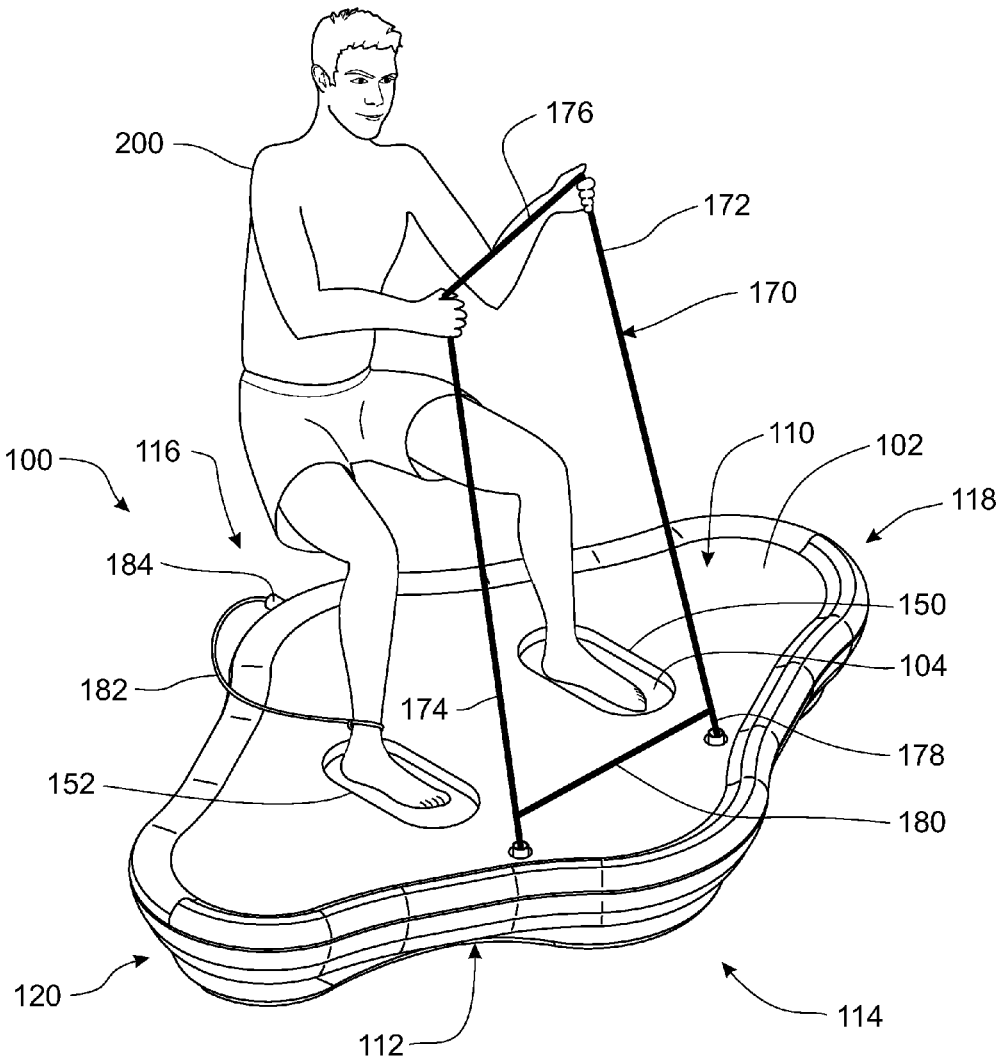
FIG. 6 presents an isometric front view of the operation of the floatation device as originally introduced in FIG. 5.

The upper layer 102 includes a carved left footprint hole 150 and a carved right footprint hole 152. The carved left footprint hole 150 and the carved right footprint hole 152 are appropriately sized to receive the left foot and the right foot, respectively, of a user situated in a standing position on floatation device 100, as best depicted in FIG. 6. In this standing position, the user places the left foot and the right foot in holes 150 and 152 respectively, resting the feet on the surface of main body layer 104 (underneath upper layer 102) that is exposed by the holes 150 and 152. The combination of the left footprint hole 150 and the right footprint hole 152, along with the corresponding surfaces of main body layer 104 exposed by holes 150 and 152, forms a pair of foot-receiving recesses or receptacles in the assembled configuration of floatation device 100. The combination of the upper layer 102 and the main body layer 104 serves as the deck or platform on which the user is positioned via the left footprint hole 150 and the right footprint hole 152. The footprint holes 150 and 152 enhance the traction of the user during operation of the floatation device 100.

The floatation device 100 further includes a cable support tubing or conduit 160 as best depicted in FIG. 3, in order to secure and locate a cable accessible to the user. A cable is threaded through the conduit 160 and made accessible to the user. In an exemplary form, the cable conduit 160 has a generally U-shaped structure including a horizontal section 162, a first vertical section 164 disposed at one end of horizontal section 162 and having a top opening 165, and a second vertical section 166 disposed at another end of horizontal section 162 and having a top opening 167. In order to receive and accommodate the installation of cable conduit 160, the floatation device 100 is equipped such that the upper layer 102 includes a left cable hole 154 and a right cable hole 156, and the main body layer 104 includes a left cable hole 155 aligned with the left cable hole 154 in upper layer 102 and a right cable hole 157 aligned with the right cable hole 156 in upper layer 102.

During installation of cable conduit 160, the first vertical section 164 of cable conduit 160 is inserted through the pair of aligned holes 156 and 157 formed in the upper layer 102 and the main body layer 104, respectively, and the second vertical section 166 of cable conduit 160 is inserted through the pair of aligned holes 154 and 155 formed in the upper layer 102 and the main body layer 104, respectively. In this installed position, the cable conduit 160 is positioned such that its horizontal section 162 lies between the main body layer 104 and the mid layer 106. Additionally, the top opening 165 of the first vertical conduit section 164 and the top opening 167 of the second vertical conduit section 166 lie above the upper surface of upper layer 102, as best depicted in FIG. 1. The cable holes 154, 155, 156, and 157 can be placed at any selected locations depending upon the desired location of the cable.

Figure 5:
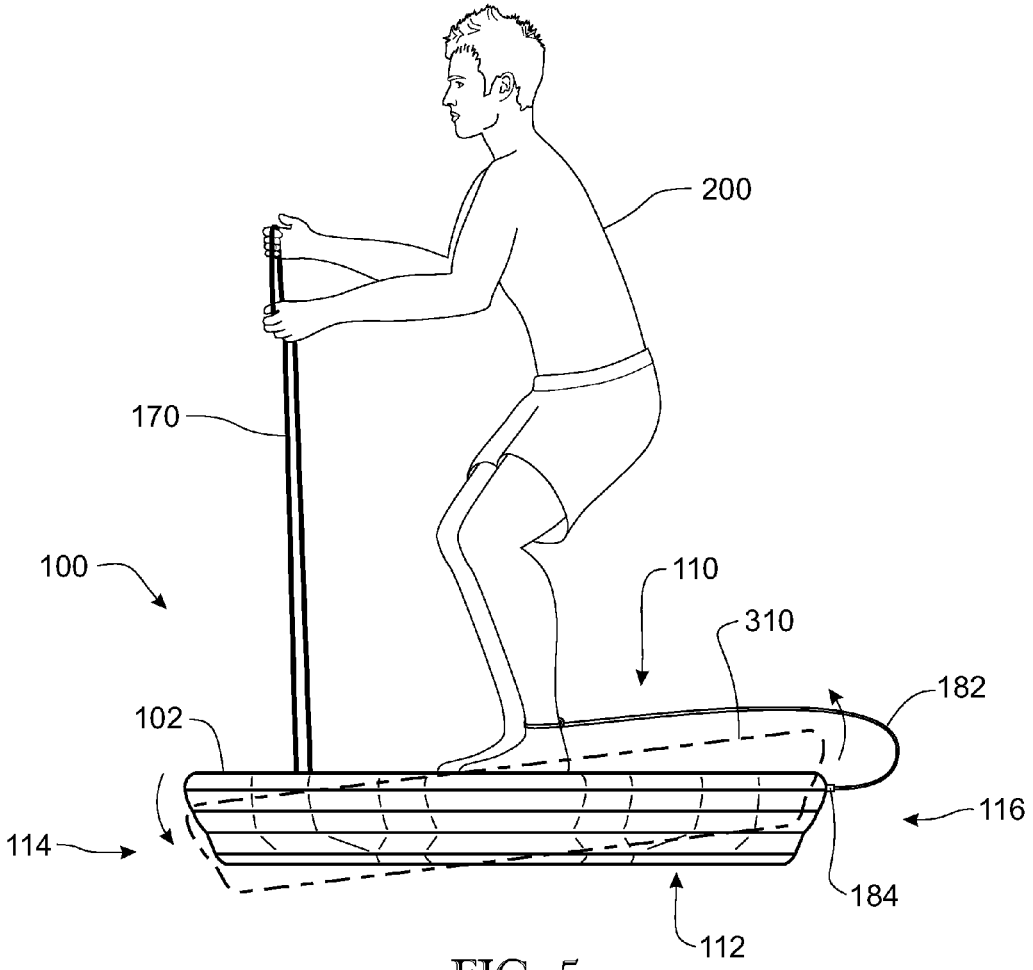
FIG. 5 presents a side view of the floatation device originally introduced in FIG. 1, demonstrating a mode of operating the floatation device by a user.

The floatation device 100 further includes a cable 170 that is threaded through cable conduit 160 and forms a loop accessible to the user 200, as best depicted in FIGS. 5 and 6. The cable 170 includes a left side 172, a right side 174, an upper end 176, a lower end 178 threading through the cable conduit 160, and a bridge, rung or connecting section 180 that spans between the left cable side 172 and the right cable side 174. The cable 170 has a suitable length to permit the user or operator 200 to grasp the upper cable end 176 at a body height favorable to steering the floatation device 100 and maintaining balance, such as waist height when the user 200 is in a fully upright position. The floatation device 100 optionally includes a tether 182 having a connecting end attached to a fixture 184 located on the rear corner 132 of upper layer 102, and a free end available for releasable attachment to the user ankle, as best depicted in FIGS. 1, 3 and 6. The tether 182 functions to keep the user safely attached to the floatation device 100 in the event of a fall.

The operation of floatation device 100 is best presented in FIGS. 5 and 6. The user 200 must first board or mount the floatation device 100 before engaging in water travel (i.e., riding floatation device 100). Initially, in order to mount or climb aboard the floatation device 100, the user 200 will likely need to swim to waters at least deep enough to have half of the user body underwater in a standing position. To mount the floatation device 100 at upper layer 102 from a swimming position, the user 200 first approaches the floatation device 100 from its rear end 116. The user 200 should then pull the lower cable rung 180 of cable 170 in order to slide the floatation device 100 under the user body, which enables the user to subsequently mount the floatation device 100 at upper layer 102. The user 200 can then attempt to stand up by grasping the upper end 176 of cable 170 and pulling on it until it becomes taut, providing stability and balance. At this time the user 200 can also insert his/her feet into the recesses formed by the left footprint hole 150 and the right footprint hole 152, which readies the user for water travel.

In order to start traveling from the crouched or standing position, the user 200 uses a side-to-side rocking motion in which the user 200 shifts his/her weight in an alternating sequence between the lateral sides of floatation device 100. This rocking motion effectuates rapid turns in the floatation device 100 that act to propel the floatation device 100 in the forward direction. The floatation device 100 can thus be self-propelling if used in calm waters, or can use the assistance of wave motion to supplement the motion activity performed by the user.

In particular, during operation, the user 200 shifts his/her weight onto one foot (e.g., the foot in recess 150 of FIG. 4), which loads or weighs down that side 118 of the floatation device 100 receiving the shifted weight, causing the loaded side to sink. In response, the other (opposite) side 120 of the floatation device 100 from which the weight has been lifted correspondingly rises because it is now unloaded. While the floatation device 100 is in this rotated or pivoted position due to the weight shifting, with the unloaded side 120 higher than the loaded side 118, the user initiates a forward kicking motion with the unloaded foot (i.e., the foot in recess 152), which causes the floatation device 100 to turn in the direction 300. This turn also advances the floatation device 100 forward due to the forward direction of the kicking motion. Following this forward kicking motion, the user 200 then immediately switches the body weight to the other side, i.e., the weight shifts back to side 120 so that the now loaded foot in recess 152 sinks down and the now unloaded foot in recess 150 rises up with the unloaded side 118. In this position, the user initiates a forward kicking motion with the unloaded foot in recess 150, which causes the floatation device 100 to turn in the direction 302 opposite the previous turning direction 300. The user continues this cycle of alternating weight shifts and alternating foot kicks.

The user repeats this sequence of alternately shifting weight from one side to the next while simultaneously performing a forward kicking motion with the elevated foot at the currently unloaded side of the floatation device 100. The net effect of this alternating shift in body weight, accompanied by the alternating kicking motions at the alternately unloaded sides, is to create a rapid sequence of small turns in floatation device 100 that collectively propel the floatation device 100 in the forward direction. The user can steer the floatation device 100 by appropriately changing the relative intensity of the forward kicking motions at the opposite sides of the floatation device 100, creating more turning momentum in one direction than the other. The user can travel in a generally straight line by employing forward kicking motions of comparatively equal strength at the opposite sides of the floatation device 100. Observed from above (FIG. 4), there is a succession of turning motions that alternate from one side to the next (e.g., left-to-right then right-to-left). The elevated or raised foot at the unloaded side (i.e., the side where the weight has been shifted away) is the foot used to implement the forward kicking motion and advance the floatation device 100 in a turning motion.

In the standing operating position, the floatation device 100 sits downward in the water in the forward direction, creating a forward tilted orientation 310 as depicted in FIG. 5. An exemplary angle of tilt is 10 degrees relative to the horizontal plane.

The floatation device 100 provides several advantages over the current art. Conventional types of personalized watercraft like surf boards require the presence of moving water to balance the surf board while standing. The surf board has a high tendency to rotate when a user stands on it in calm waters. Typical surf boards are designed to be moved by waves, so in calm waters the surf board will rotate when standing on it, leading to a loss of balance and an overturn of the surf board. However, the design of the floatation device 100 inhibits this side-to-side rotation, allowing a user to readily stand on the floatation device 100 in a fully balanced position in calm waters. The floatation device 100 is also effective in hydrodynamic conditions, i.e., wavy waters. The design of the floatation device 100 facilitates a side-to-side rocking motion that alternately loads and unloads opposite sides of the floatation device 100, which in combination with alternating kicking motions at the unloaded sides enable the user to self-propel the floatation device 100. The floatation device 100 features stability and balance in both hydrostatic (e.g., lake or pool) and hydrodynamic (e.g., river or ocean) conditions, and supports the capability of a user to self-propel the watercraft even in hydrostatic conditions.

An alternative embodiment recreational water flotation device, also referred to as a floatation device, is illustrated in its various aspects in FIGS. 7 through 21. As best shown in FIGS. 7 through 12, the alternative embodiment floatation device 400 has a central body 404 which defines an upper side 410, a bottom surface 412 (FIG. 10), a front end 414, and a rear end 416. The rear end 416 extends farther to the rear than the front end 414 projects forward and thus acts as a tail to assist in rotational stabilization of the floatation device 400. A left lateral element 405 and a right lateral element 407 are affixed to the left and right sides of the body 404 respectively. The body 404, left lateral element 405, and right lateral element 407 are formed of a hydrodynamic flotation material such as a rigid closed cell polymeric foam of sufficient buoyancy to support a human being on the surface of a body of water. Most preferably, the body 404, left lateral element 405, and right lateral element 407 are formed of a single homogenous body of polymeric foam which, in turn, is machined or cut to create its finished three dimensional profile. In particular, the left lateral element 405 and the right lateral element 407 both include left and right canted surfaces 419, 421 respectively wherein the left canted surface 419 and right canted surface 421 are sloped to the center of the body 404 and raised above upper side 410 as most clearly illustrated in FIG. 7. The canted surfaces 419, 421 are intended to function as footpads for a user 200 to stand thereupon as described in greater detail below. The canted surfaces 419, 421 can optionally be textured or covered with a non-skid coating to provide secure footing for the user 200. Alternative embodiments are contemplated in which the body 404 can include one or more inflatable portions or bladders that can be selectively inflated as desired by the user. In some embodiments, the body 404 can comprise a single, inflatable portion or bladder that can be selectively inflated as desired by the user.

Figure 15:
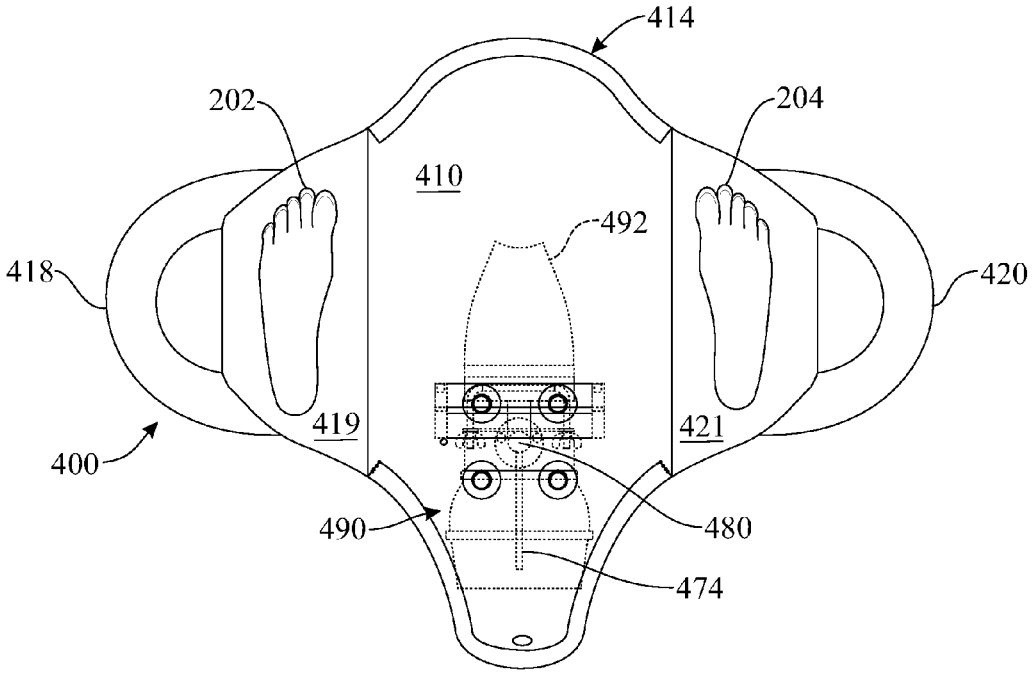
FIG. 15 presents a top plan view of the floatation device of FIG. 7 with a user's feet placed atop thereof.
Figure 16:
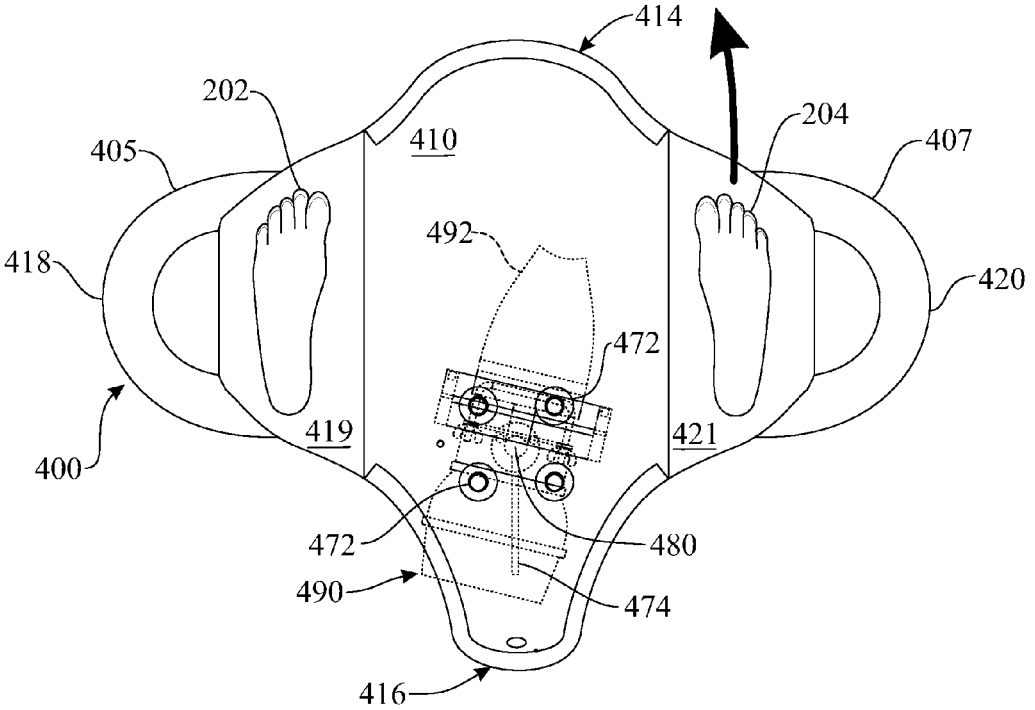
FIG. 16 presents a top plan view of the floatation device of FIG. 7, wherein the user is urging a right side of the floatation device forward.

In plan form, and as most clearly seen in FIGS. 15 and 16, the left lateral element 405 defines an arcuately convex left lateral side 418 and the right lateral element 407 also defines a convexly arcuate right lateral side 420. The front end 414 and the rear end 416 are also arcuately convex, and the peripheral areas connecting adjacent ones of the left lateral side 418, the front end 414, the right lateral side 420, and the rear end 416 are generally arcuately concave such that the periphery as a whole is a series of alternating convexities and concavities. The floatation device 400 is thus shaped as a generally four-lobed body, the four lobes being provided by the left lateral side 418, the right lateral side 420, the front end 414 and the rear end 416, and including the said two opposed sloped or canted surfaces 419, 421 converging towards the upper side 410. Further, the width of the floatation device 400 from the left lateral side 418 to the right lateral side 420 is greater than the length of the body 404 from the front end 414 to the rear end 416.

Figure 7:
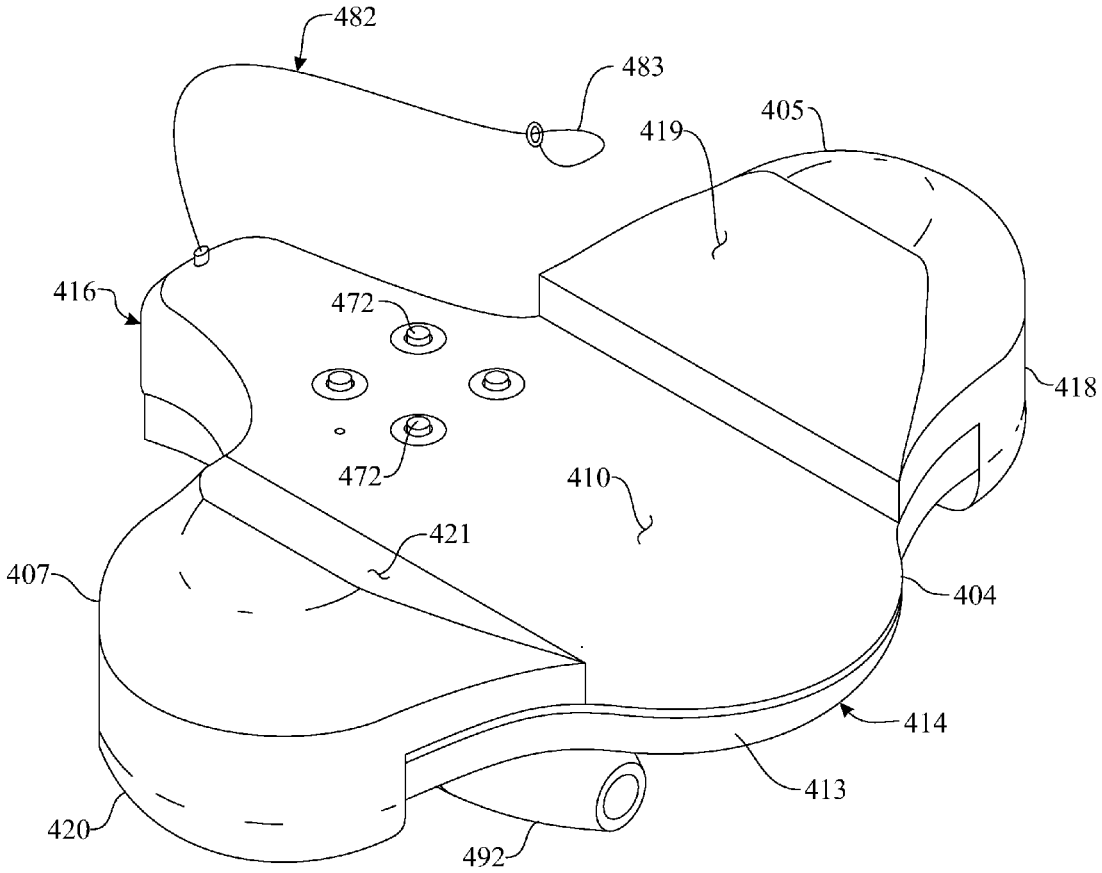
FIG. 7 presents a top front isometric view of a floatation device, according to a second exemplary embodiment of the present invention.
Figure 8:
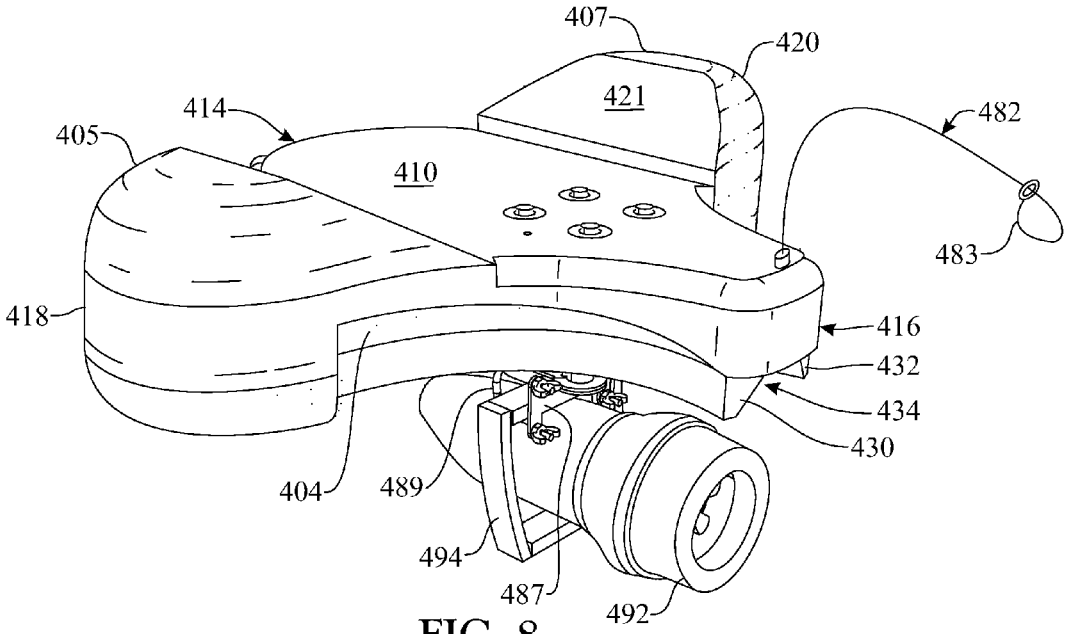
FIG. 8 presents a top rear isometric view of the floatation device of FIG. 7.

As shown in FIG. 7, a tether 482 is affixed to the rear end 416 of the floatation device 400. The tether 482 includes a loop 483 at a free end thereof. The size of the loop 483 is adjustable such that the user 200 is able to place the loop 483 around either the user's left or right ankle and adjust the loop 483 to a comfortable tightness. The use of the tether 482 keeps the floatation device 400 within reach of the user 200 in the event that the user 200 falls off the floatation device 400 while in the water.

Figure 9:
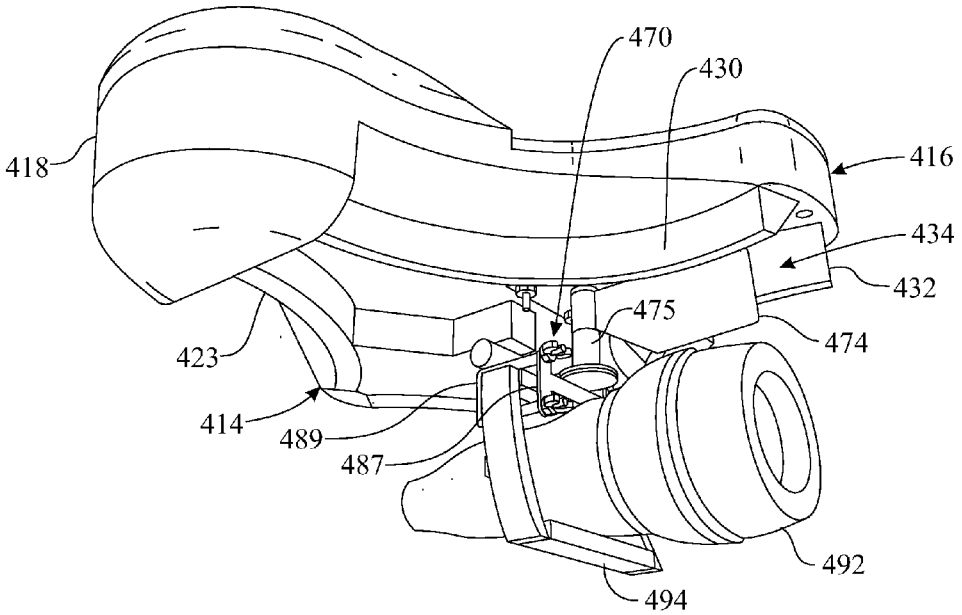
FIG. 9 presents a bottom rear isometric view of the floatation device of FIG. 7.

As most clearly seen in FIGS. 9 and 10, the left lateral side 418 of the left lateral element 405 and the right lateral side 420 of the right lateral element 407 extend below the bottom surface 412 of the central body 404. A front fin 423 includes a left front fin element 425 and a right front fin element 427. The front fin 423 is affixed to the bottom surface 412 proximate to the front end 414 and extending from the left lateral side 418 to the right lateral side 420. The fin elements 425, 427 are arcuately concave to more closely match the front contour of the central body 404. The left and right front fin elements 425, 427 can have a trapezoidal shaped cross-section wherein the widest base is affixed to the bottom surface 412. A front edge 413 of the central body 404 can be angled toward the rear at approximately the same angle as the trapezoidally shaped left and right front fin elements 425, 427 to provide a smooth flow of water thereover as the floatation device 400 passes through the water. Additionally, a left rear fin 430 and a right rear fin 432 are also formed as arcuately concave and are affixed to the bottom surface 412 at the rear periphery of the central body 404. Further, the concave curvature of the rear fins 430, 432 proximately converge one with the other at the rear end 416, to centrally direct the flow of water to towards an exit space 434 arranged between the rear fins 430, 432, to further directionally stabilize the floatation device 400 while moving through the water.

Figure 18:
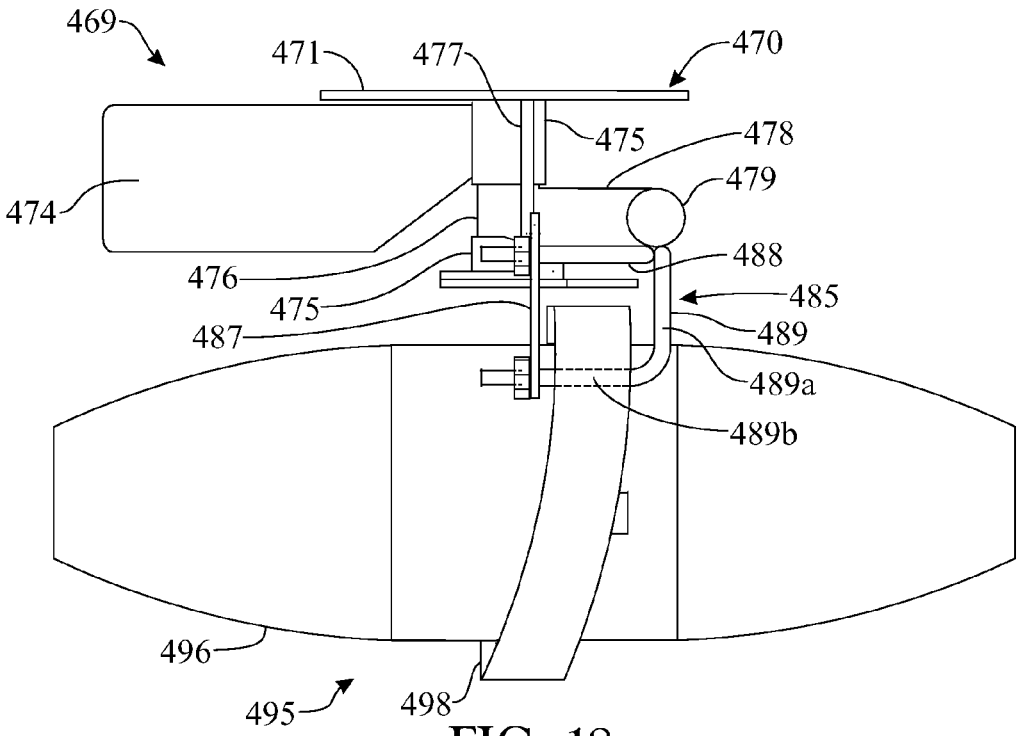
FIG. 18 presents a side elevation view of a bottom connector assembly attachable to the bottom of the floatation device showing the mounting of a weight thereto.
Figure 19:
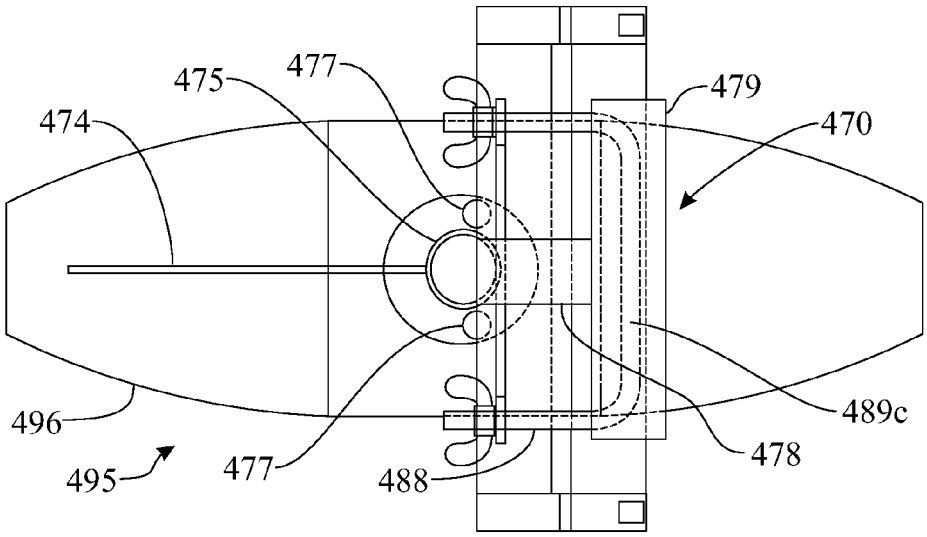
FIG. 19 presents a top plan view of the bottom connector assembly and weight of FIG. 18.
Figure 20:
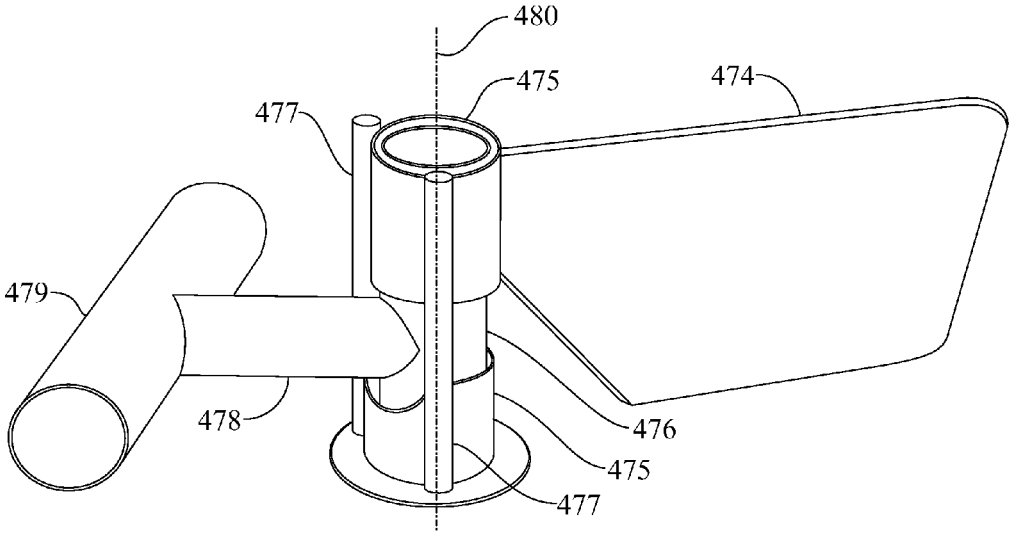
FIG. 20 presents an isometric view of a portion of the bottom connector assembly of FIG. 18 partially rotated.
Figure 21:
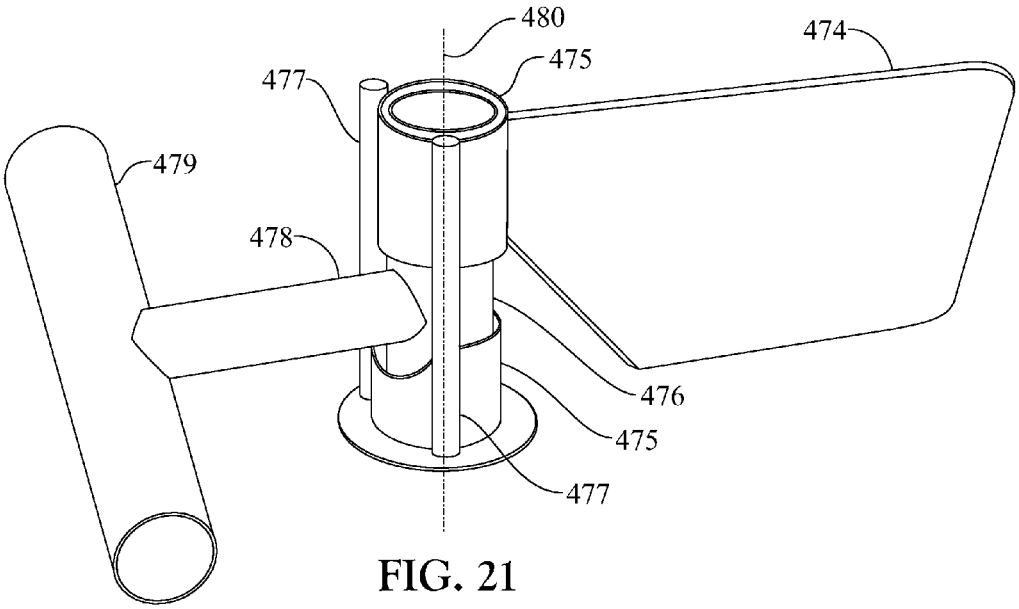
FIG. 21 presents an isometric view of the portion of the bottom connector assembly of FIG. 20 in a non-rotated position.

Referring now to FIGS. 8 through 10, and 18 through 21, a bottom mount 470 is mounted to the bottom surface 412 with four mounting bolts 472. The central body 404 defines four holes 411 (FIG. 10) arranged in a square pattern that is laterally centered and positioned more proximate to the rear and 416 than to the front end 414. The bottom mount 470 includes a mounting plate 471 comprising four mounting holes 473 which engage the four mounting bolts 472 to secure the bottom mount 470 to the bottom surface 412. A fixed outer tube 475 is perpendicular to and affixed to the mounting plate 471. A longitudinal fin 474 is rigidly affixed to the rear of the fixed outer tube 475 and extends rearwardly from the fixed outer tube 475 to aid in longitudinal stability. An inner tube 476 is retained within the fixed outer tube 475 and is rotatable therein defining a rotation axis 480, as best shown in FIGS. 20 and 21. The outer tube 475 comprises upper and lower segments spaced apart one from the other in a fixed vertical relationship and connected one to the other with two vertical stop bars 477 affixed to the left outer surface and the right outer surface of the fixed segments of the outer tube 475. The vertical stop bars 477 define the left and right boundaries of the opening. The upper and lower segments of the fixed outer tube 475 in combination with the two stop bars 477 define a forwardly oriented opening exposing a portion of the inner tube 476. Alternatively, the fixed outer tube 475 can be a unitary tube (not shown) which defines a forward facing cutout thereby exposing the portion of the inner tube 476.

With continued reference to FIGS. 20 and 21, a transverse tube 478 is affixed to the inner tube 476 and extends forwardly from the inner tube 476 through the opening defined by the outer tube 475 and the vertical stop bars 477. A cross tube 479 is horizontally oriented and affixed to the distal forward end of the transverse tube 478 such that the transverse tube 478 and the cross tube 479 together form a "T". The combination of the inner tube 476, the transverse tube 478, and the cross tube 479 can rotate within the outer tube 475 and is rotationally limited by the stop bars 477.

Figure 10:
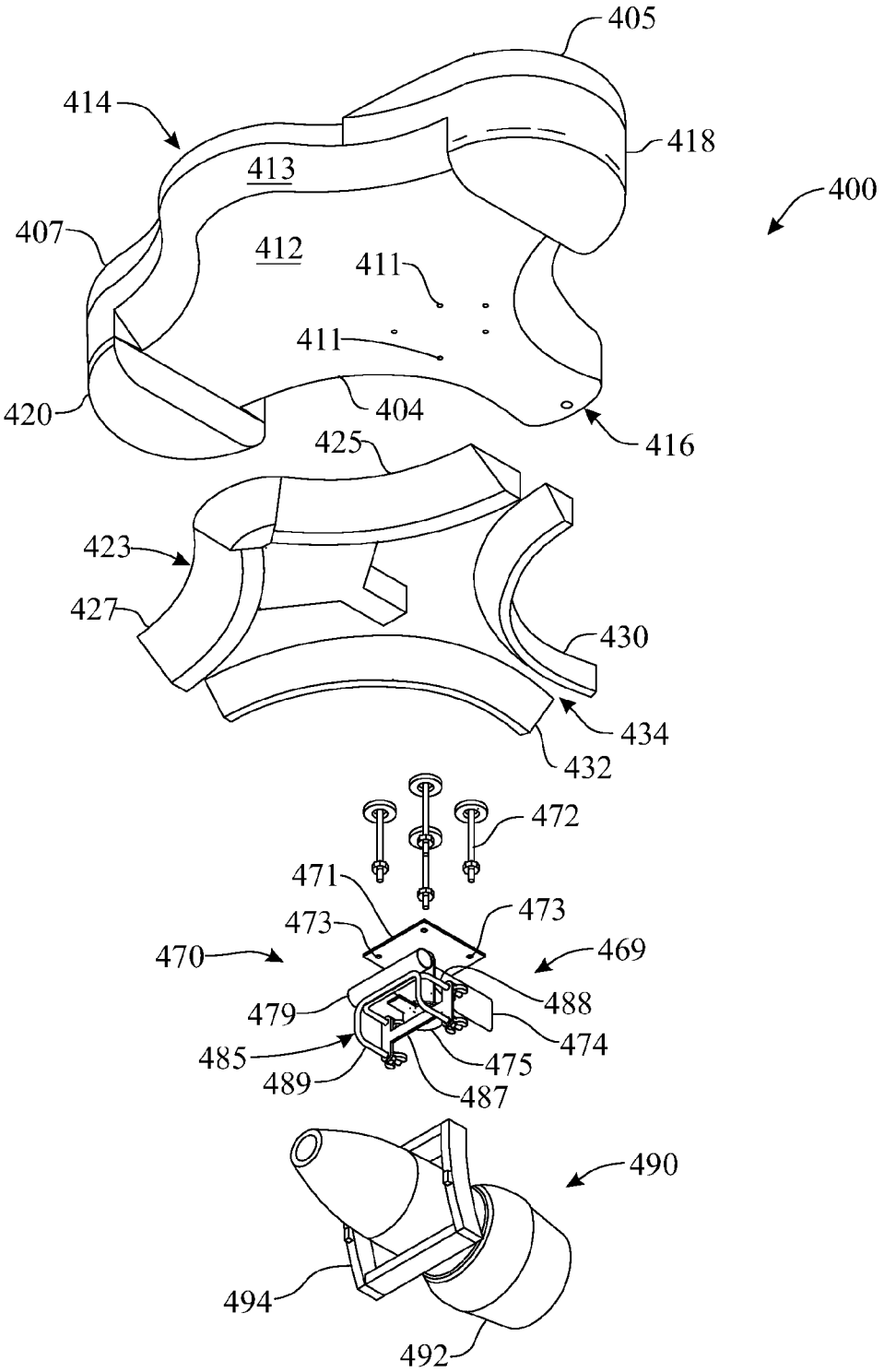
FIG. 10 presents an exploded bottom front isometric view of the floatation device originally introduced in FIG. 7.
Figure 11:
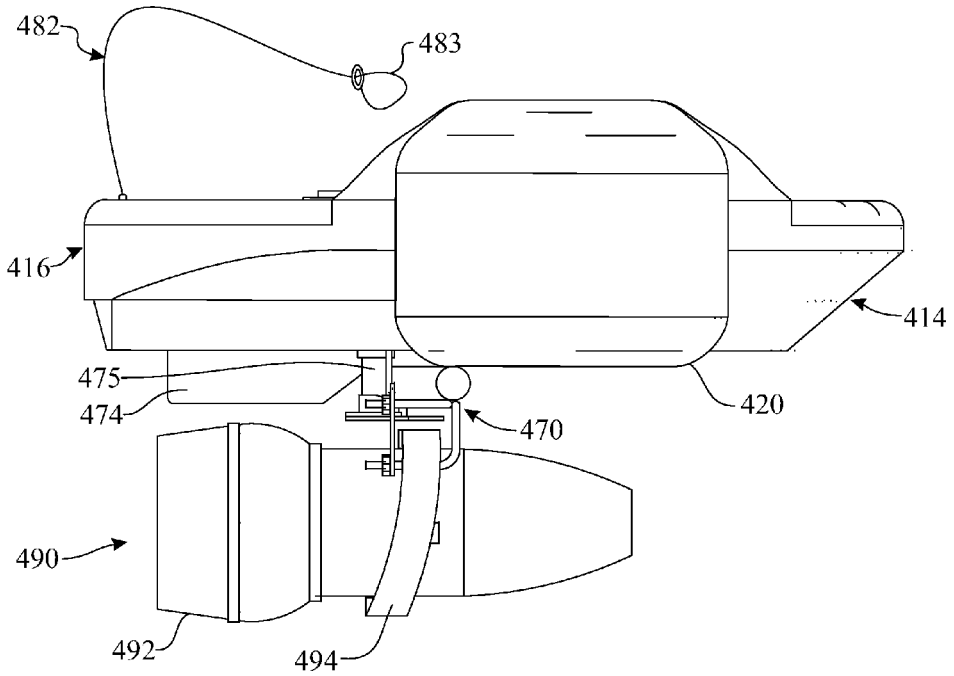
FIG. 11 presents a left side elevation view of the floatation device of FIG. 7.
Figure 12:
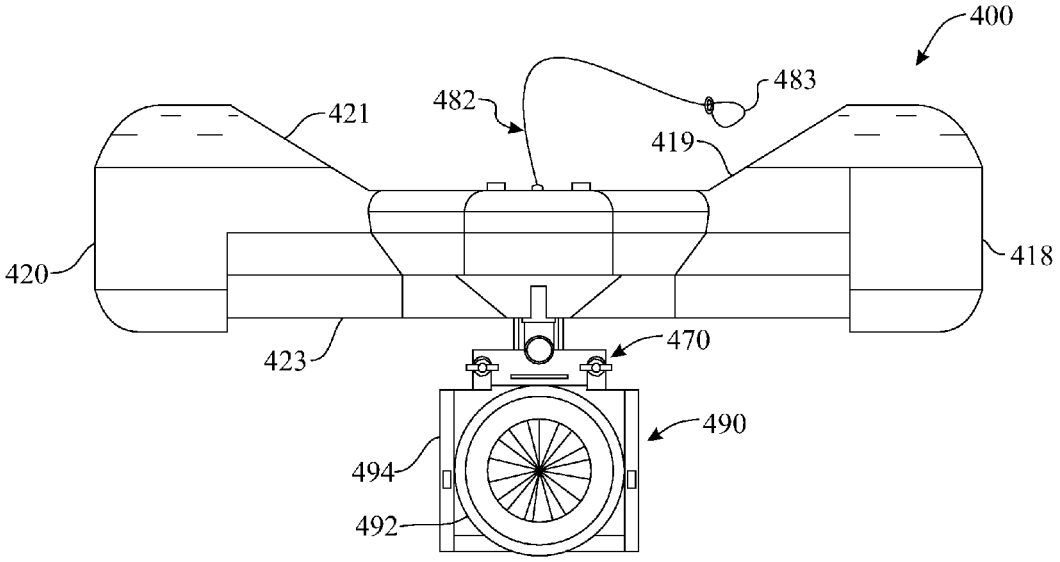
FIG. 12 presents a rear elevation view of the floatation device of FIG. 7.

As shown in FIGS. 10 and 18, a bottom bracket 485 is affixed to the cross tube 479 and comprises a vertically oriented bracket plate 487 in the shape of the letter "H", an upper bracket bar 488 in the shape of the letter "U", and a lower bracket bar 489 in the shape of a transversely bent letter "U". The upper bracket bar 488 is removably attached to an upper portion of the bracket plate 487, and the lower bracket bar 489 is removably attached to a lower portion of the bracket plate 487. As best shown in FIG. 18, the bottom bracket 485 includes two vertical segments 489*a*, two horizontal segments 489*b*, and a top transverse segment 489*c*. The top transverse segment 489*c* is affixed to the cross tube 479.

The floatation device 400 further comprises a propulsion unit 490 including a battery-powered propeller 492 and a propeller mount 494. When activated, the propeller 492 can aid in propelling the floatation device 400 across the surface of a body of water.

Figure 17:
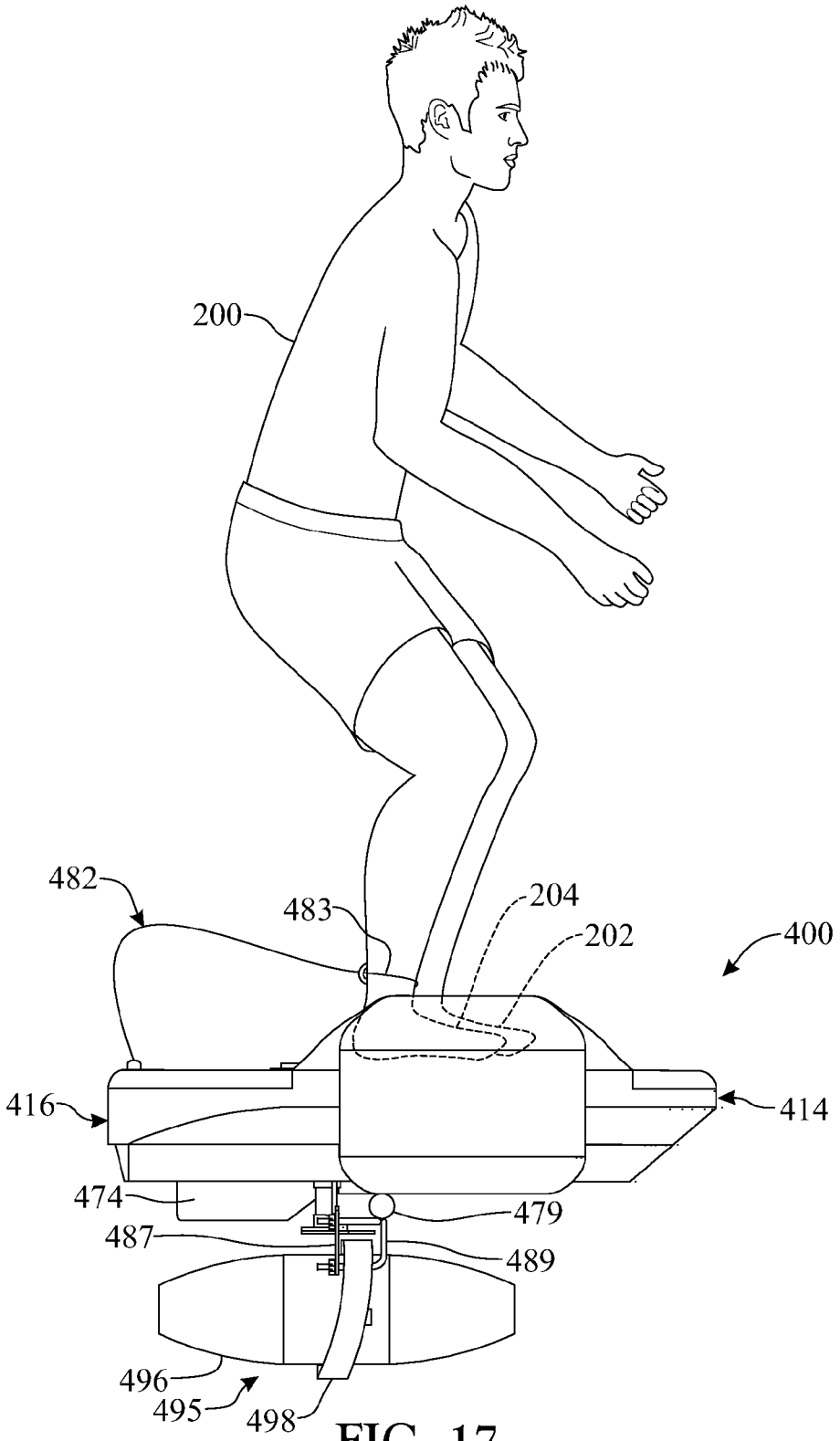
FIG. 17 presents a left side elevation view of the floatation device of FIG. 7 with a user standing on top thereof, and having replaced the propeller with a weight.

The floatation device 400 can also comprise a weight unit 495 which, as shown in FIGS. 17 through 19 (showing the weight unit 495 in lieu of the propulsion unit 490). The weight unit 495 can include a weight 496 and a weight mount 498, similarly to the propulsion unit 490. In alternative embodiments, the propeller mount 498 could interchangeably receive the propeller 492 and the weight 496. The weight 496 can be a solid body or alternatively a hollow body that is filled with water, sand, or other dense material. The weight 496 aids in stabilization of the floatation device 400 floating on the water surface by lowering its center of gravity. Use of the weight 496 in lieu of using the propeller 492 provides a more strenuous workout for the user 200 to progress over the water surface. Preferably, the floatation device 400 is configured so that the propeller 492 and the weight 496 can be interchangeably used.

The propulsion unit 490 and the weight unit 495 of the present embodiment are interchangeably attached to the floatation device body 404 by having the propeller mount 494 or weight mount 498 hang from the horizontal segments 489*b* of the lower bracket bar 489. As best shown in FIG. 18, the vertically oriented bracket plate 487, the upper bracket bar 488, and the bottom bracket bar vertical segments 489*a* and horizontal segments 489*b* retain the propeller mount 494 or weight mount 498 therebetween. The propulsion unit 490 or weight unit 495 are rotatable with respect to the floatation device body 404 around rotation axis 480.

Figure 13:
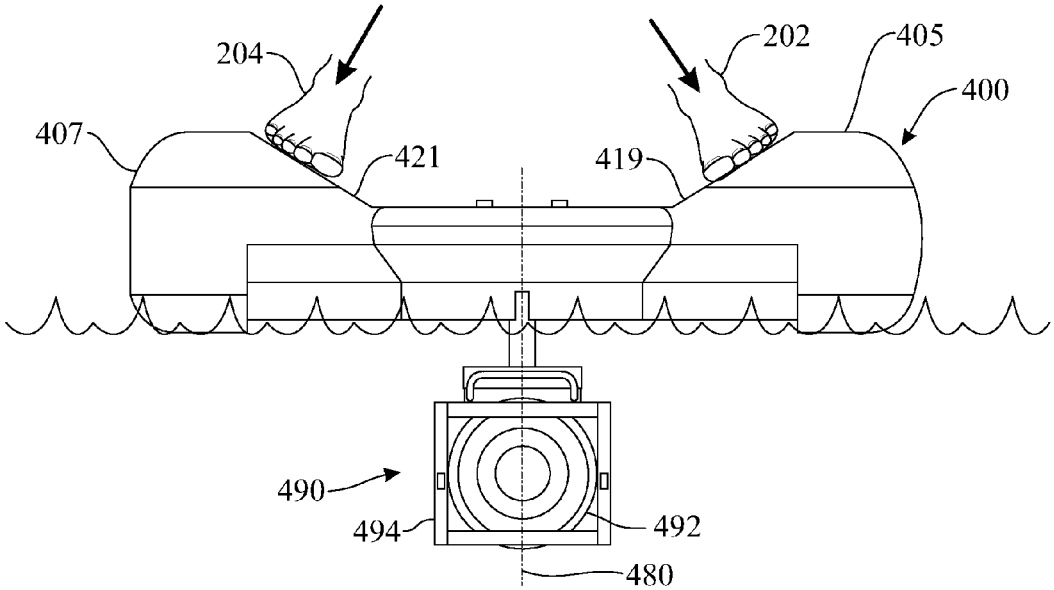
FIG. 13 presents a front elevation view of the floatation device of FIG. 7 in use and floating in a body of water and a user standing on the floatation device.

Operation of the floatation device 400 is demonstrated in FIGS. 13 through 17. Use of the device is initiated by a user 200 placing the tether loop 483 about either his right or left ankle and standing on the floatation device 400, placing his left foot 202 on the left canted surface 419 of left lateral element 405 and placing his right foot 204 on the right canted surface 421 of right lateral element 407. The user 200 distributes his weight equally against the surfaces 419, 421 to maintain a level stance of the floatation device 400 in the water as best illustrated in FIG. 13. The propulsion unit 490, and particularly the propeller 492, at this point is centered with its thrust acting along the longitudinal centerline between front end 414 and rear end 416 (FIG. 15). Starting the propeller 492 causes the floatation device 400 to begin to move forward along the water.

Figure 14:
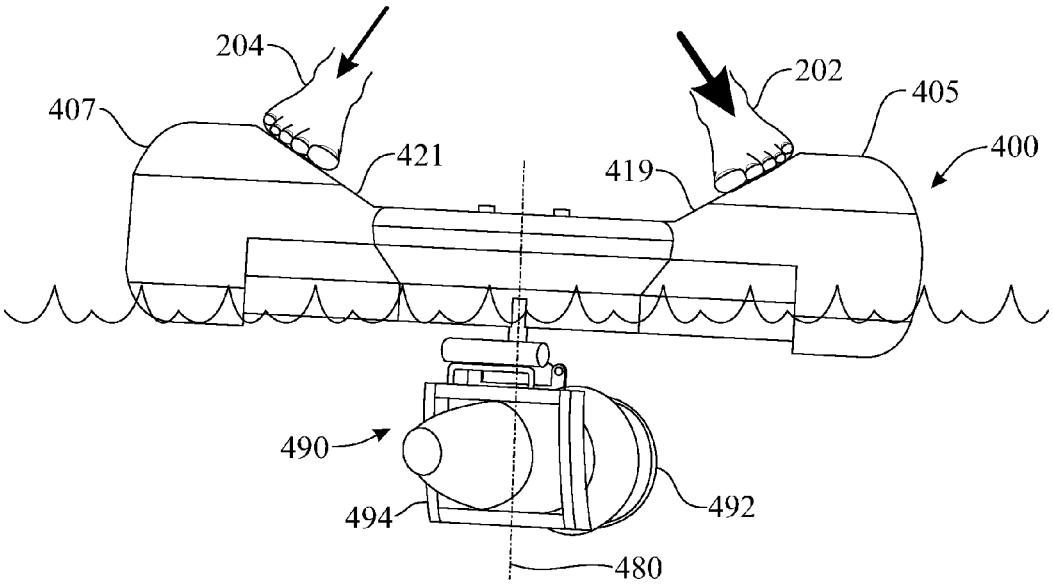
FIG. 14 presents a front elevation view of the floatation device of FIG. 7, wherein the user has shifted his weight to his left foot.

To further move the floatation device 400 across the surface of the water, and enjoy the full riding and exercising experience, the user 200 shifts his weight to the left, as indicated by the larger arrow of FIG. 14, thereby placing a greater force on the left canted surface 419 and effectively unloading a portion of his weight from right canted surface 421. This causes the left lateral element 405 to sink into the water and the right lateral element 407 to rise higher in the water relative to the left lateral element 504; in consequence, the left lateral element 405 tends to be stopped by water causing the floatation device 400 to slightly turn left. In addition, if the user's stepping force is slightly oriented forward in a sort of "crawling" or circular fashion, the stepping force will cause the floatation device 400 to slightly tilt forward; in consequence, the floatation device 400, and thus the rotation axis 480, tilt sideways and forward as shown in FIG. 14. The forward and sideways tilting of the rotation axis 480 causes the propulsion unit 490 to freely rotate in a clockwise direction, so that its front portion is rotated towards the right lateral element 407 and its rear portion is rotated towards the left lateral element 405, as shown in FIG. 14; in consequence, the propeller 492 propels the floatation device 400 towards the right. The aforementioned leftward turning effect caused by stepping on the left canted surface 419 is counteracted by the propeller 492 pointing rightward and thus propel the floatation device 400 towards the right; such counteraction causes an overall effect of the floatation device 400 tending to maintain a forward movement, in the longitudinal directing extending from the floatation device rear end 416 towards the floatation device front end 414. The non-turning longitudinal fin 474 further contributes to maintain the longitudinal forward movement of the floatation device 400. In addition, stepping on the left canted surface 419 and rising of the right canted surface 421 as shown in FIG. 14 enables the user 200 to apply a forward frictional force with his right foot 204 against the right canted surface 421 to further contribute to rotate the floatation device 400 leftward, about the left lateral element 405. In other words, the user 200 uses his right foot 204 to frictionally "kick" the right lateral element 407 forward and rotate the floatation device 400 forwardly and rotationally about the left lateral element 405, as indicated in FIG. 16.

After having kicked forward as shown in FIG. 16, the user 200 will then shift his weight to his right foot 204. Utilizing his left foot 202, the user 200 applies a forward force to the left canted surface 419 with his left foot 202 to rotate about the right lateral element 407. The forward movements alternating the users left foot 202 and right foot 204 are continued until the user 200 on the floatation device 400 has traversed the surface of the water the desired distance. The battery powered propeller 492 provides an aided forward thrust to assist propelling the floatation device 400 in the forward direction. In the event of replacing the propeller 492 with a weight 496, the longitudinal fin 474 will contribute to maintain a forward direction while the user 200 carries out the downward stepping, forward kicking motion.

The illustrations of FIGS. 22 through 25 present a floatation device 600 in accordance with a third exemplary embodiment of the invention. As the previous embodiments, the flotation device 600 of the present embodiment is buoyant in water. In its assembled form, the flotation device 600 includes a dorsal or upper side 602, a ventral or lower side 604, a left lateral side 606, and a right lateral side 608. The upper side 602 defines a location where a user is situated in an operating position, such as a stand-up position while navigating the floatation device 600 through water. The user mounts and rides the floatation device 600 at the upper side 602. The lower side 604 defines a location where the floatation device 600 is placed on or contacts the water. The floatation device 600 further includes an anterior, forward or front end 610 and an anterior, rearward or rear end 612. The front end 610 serves as the nose section that defines the leading edge of floatation device 600 as the floatation device 600 travels through water. The rear end 612 serves as the tail section that defines the trailing edge of floatation device 600 as the floatation device 600 travels through the water. During operation, the user faces in the direction of the front end 610. The front end 610 and the rear end 612 define a longitudinal axis of the floatation device 600, while the left lateral side 606 and the right lateral side 608 define a lateral axis of the floatation device 600.

The flotation device 600 is a floatable body including a central body 630, a left lateral element 650 extending from a left end of the central body 630, and a right lateral element 670 extending from a right end of the central body 630. The central body 630 defines an upper surface 632 and a bottom surface 634 and has a front end 636 and a rear end 638, wherein the front end 636 and rear end 638 of the central body 630 define the front end 610 and the rear end 612 of the flotation device 600. The left lateral element 650 defines a top left canted surface 652 that is canted or sloped toward the upper surface 632 of the central body 630. Similarly, the right lateral element 670 defines a top right canted surface 672 that is canted or sloped downward toward the upper surface 632 of the central body. The left lateral element 650 and the right lateral element 650 define a left end and a right end, respectively, of the flotation device 600. The central body 630, left lateral element 650 and right lateral element 670 can be integrally formed into a single piece made of floatable materials such as, without limitation, Expanded polystyrene (EPS) foam, Polyurethane foam, cork, rubber, or the like. Alternative embodiments are contemplated in which the flotation device 600 can include one or more inflatable portions or bladders that can be selectively inflated as desired by the user. In some embodiments, the flotation device 600 can comprise a single, inflatable portion or bladder that can be selectively inflated as desired by the user. Similarly to the embodiment of FIG. 7, the top left canted surface 652 and top right canted surface 672 are preferably non-slippery when humid or wet, and provide a sufficiently large surface area for a user to place a foot on each top canted surface 652, 672.

Similarly to the previous embodiments, a user of the flotation device 600 of the present embodiment is able to "walk" on water by standing on the floatation device (more particularly, on the top left canted surface 652 and the top right canted surface 672) and carrying out a cyclic side-to-side rocking and forward-stepping movement. For instance, in a first step, the user shifts his or her weight to the right foot, causing the flotation device 600 to tilt and the left end of the flotation device 600 to elevate and become less submerged in water. The user then carries out a forward kicking motion with the left foot, causing the left lateral element 650 to shift forward due to friction between the left foot and the top left canted surface 652 (and facilitated by the fact that the left end of the flotation device 600 is elevated and thus less submerged). Next, the user shifts his or her weight to the left foot, sinking the left end of the flotation device 600 and elevating the right end of the flotation device 600. The user then carries out a forward kicking motion with the right foot, causing the right lateral element 670 to shift forward due to friction between the right foot and the top right canted surface 672. The user then shifts his or her weight to the right foot and repeats the cycle. The action of shifting the weight to alternating sides is facilitated by the fact that the user is standing on canted surfaces 652, 672 which are sloped facing one another in a V-shaped spaced-apart configuration, and thus oriented towards the user's hips. In addition, the fact that the top left canted surface 652 and top right canted surface 672 are sloped facing one another contributes to prevent the user's feet from slipping transversely outward when using the device, and especially when carrying out the stepping motion.

Figure 22:
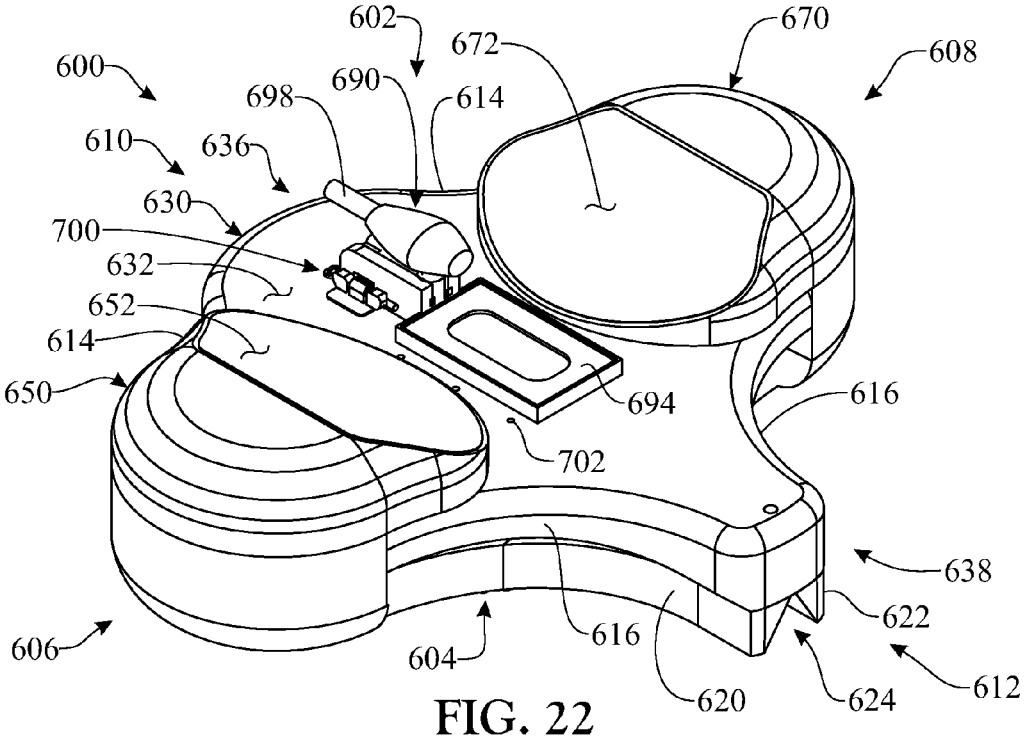
FIG. 22 presents a top rear isometric view of a third exemplary embodiment of a floatation device, according to a third exemplary embodiment of the present invention.
Figure 23:
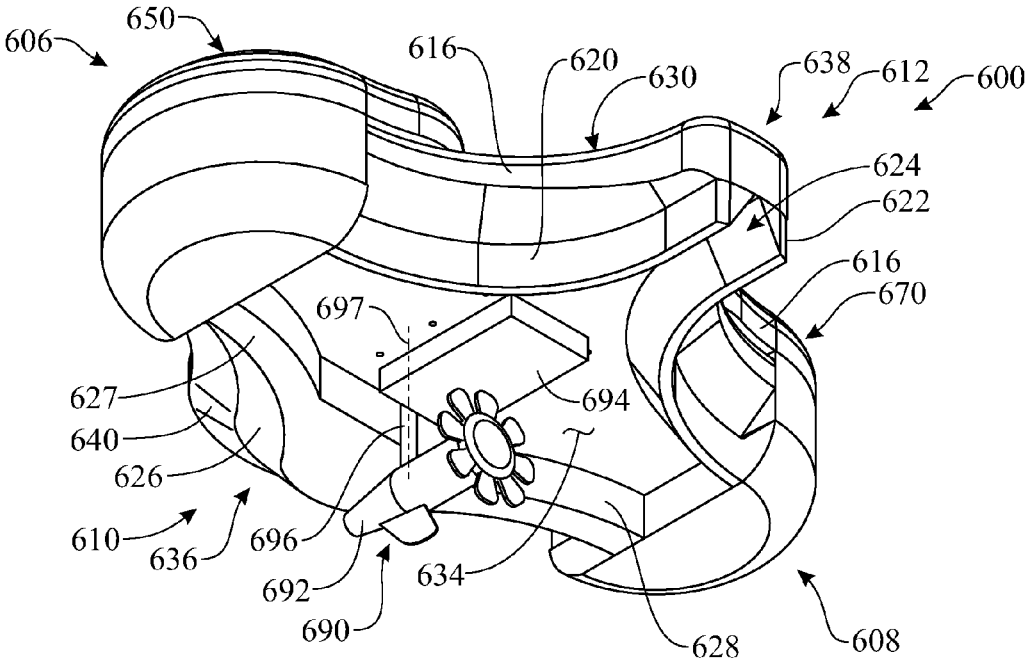
FIG. 23 presents a bottom rear isometric view of the floatation device of FIG. 22.

In order to facilitate moving forward along water, the flotation device 600 can further include a propulsion unit 690. The propulsion unit 690 of the present embodiment comprises an electrically-driven propeller 692 arranged beneath the central body 630, and a battery assembly 694 for providing electrical power to the propeller 692. The battery assembly 694 can include one or more batteries. In addition, the battery assembly 694 can include wiring and/or a protective box for housing the one or more batteries. The battery assembly 694 of the present embodiment is partially embedded or housed in the main body of the flotation device 600, such as directly embedded or, alternatively, contained in a box which is in turn embedded in the main body of the flotation device 600. For increased balance, stability and ease of use, the battery assembly 694 is particularly embedded in a central region of the central body 630. As shown in FIGS. 22 and 23, top and bottom ends of the battery assembly 694 protrude outwardly from the upper surface 632 and the bottom surface 634 of the central body 630, respectively. In alternative embodiments, however, the battery assembly may be flush with the upper surface and/or the lower surface of the central body. The battery assembly can be housed within a cavity in the central body 630, and at least one battery of the battery assembly can be removable by pulling it out of the cavity towards the upper surface 632 or towards the bottom surface 634 of the central body 630. In other embodiments, at least one battery of the battery assembly may only be removable by pulling it out of the cavity towards the upper surface 632 of the central body 630. In yet other embodiments, at least one battery of the battery assembly may only be removable by pulling it out of the cavity towards the bottom surface 634 of the central body 630. In some embodiments, the battery assembly may be covered by a portion of the upper surface 632 and/or a portion of the bottom surface 634. Optionally, said portion of the upper surface 632 and/or said portion of the bottom surface 634 can be removable in order to gain access to the battery.

Figure 24:
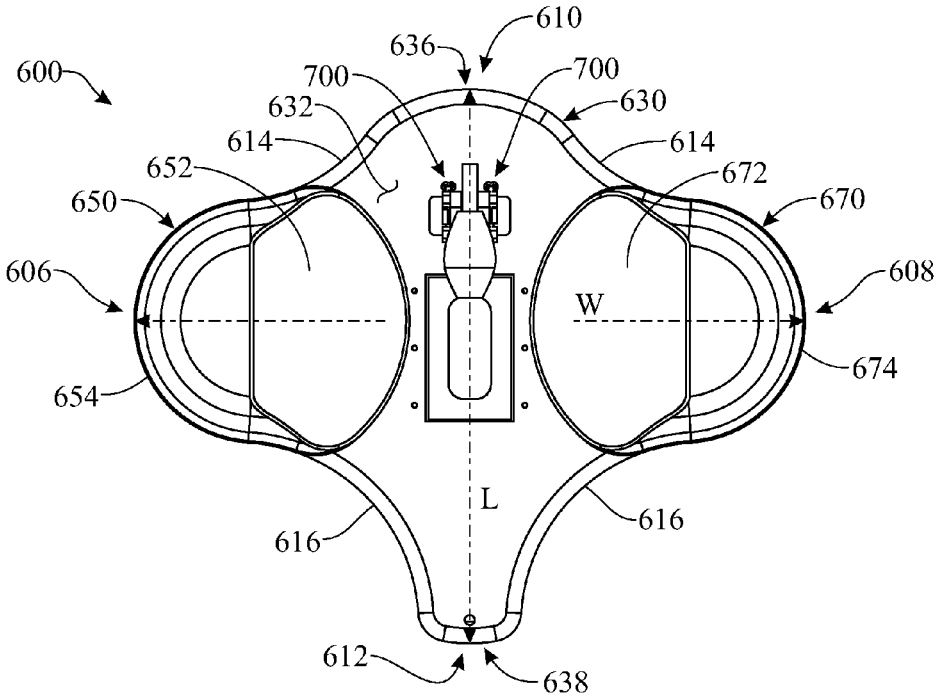
FIG. 24 presents a top plan view of the floatation device of FIG. 22.

Similarly to previous embodiments, the flotation device 600 of the present embodiment is such that the width of the flotation device 600 is greater than the length of the flotation device 600. More specifically, a left side of the left lateral element 650 (defining the left end of the flotation device 600) and a right side of the right lateral element 670 (defining the right end of the flotation device 600) define a width W of the flotation device 600, as shown in FIG. 24. In turn, the front end 636 and the rear end 638 of the central body 630 (defining the front end 610 and rear end 612 of the floatation device 600, respectively) define a length L of the flotation device 600, as shown in FIG. 24. The width W is preferably greater than the length L. Such transversely elongate shape facilitates moving forward along water, as it provides a sufficient width for the user to comfortably and stably stand on the floatation device 600 with his or her legs adequately spread apart, while having a relatively reduced length in order to minimize friction against water and yet provide sufficient stability.

In plan form, and as most clearly seen in FIG. 24, the left lateral element 650 defines an arcuately convex left lateral side 654 and the right lateral element 670 defines a convexly arcuate right lateral side 674. The front end 636 and the rear end 638 of the central body 630 are also arcuately convex. Front peripheral areas 614 and rear peripheral areas 616 connecting adjacent ones of the left lateral side 654, the front end 636, the right lateral side 674, and the rear end 638 are generally arcuately concave such that the periphery as a whole is a series of alternating convexities and concavities. The floatation device 600 is thus shaped as a generally four-lobed body, the four lobes being provided by the left lateral side 654, the right lateral side 674, the front end 636 and the rear end 638, and including the said two opposed sloped or canted surfaces 652, 672 converging towards the upper side 602. Such lobed configuration minimizes material usage and provides increased safety to the user and surrounding persons or animals in the event of an impact against the floatation device 600.

The floatation device 600 can further include a left rear fin 620 and a right rear fin 622, formed as arcuately concave and affixed to the bottom surface 634 at the rear periphery of the central body 630. The concave curvature of the rear fins 620, 622 proximately converge one with the other at the rear end 638, to centrally direct the flow of water between the rear fins 620, 622 to towards an exit space 624 arranged between rear ends of the rear fins 620, 622, to further directionally stabilize the floatation device 600 while moving through the water. The arcuately concave rear fins 620, 622 are preferably in vertical registration with rear peripheral areas 616.

As most clearly seen in FIG. 23, the left lateral side 654 of the left lateral element 650 and the right lateral side 674 of the right lateral element 670 extend below the bottom surface 634 of the central body 630. A front fin 626 includes a left front fin element 627 and a right front fin element 628. The front fin 626 is affixed to the bottom surface 634 proximate to the front end 636 and extending from the left lateral side 654 to the right lateral side 674. The left and right front fin elements 627, 628 are arcuately concave to more closely match the front contour of the central body 630. The left and right front fin elements 627, 628 can have a trapezoidal shaped cross-section wherein the widest base is affixed to the bottom surface 634. A front edge 640 of the central body 630 can be angled toward the rear at approximately the same angle as the trapezoidally shaped left and right front fin elements 627, 628 to provide a smooth flow of water thereover as the floatation device 600 passes through the water.

In a preferred embodiment of the invention, the propeller 692 of the propulsion unit 690 is attached to a central area of the central body 630 by a propeller unit connection rod 696 which defines a rotation axis 697. The propeller 692 is rotatable with respect to the central body 630. Those skilled in the art will understand that several mechanical solutions are possible to achieve rotation; for instance, the propeller 692 can be rotatably connected to the propeller unit connection rod 696 by bearings or the like; in alternative embodiments, both the propeller 692 and the propeller unit connection rod 696 can be jointly rotatable with respect to the central body 630. The propeller 692 is preferably configured to rotate freely with respect to the central body 630, similarly to the embodiment of FIG. 7. By freely, it is understood that the propeller 692 is not actively driven to rotate by any electrical or other operating mechanisms or devices, but rather is caused to rotate only by external forces such as gravity and/or water forces. Rotation can take place in any given direction. In some embodiments, rotation can be limited within a predetermined angle range (e.g., 45 degrees) to achieve a more controlled forward movement of the floatation device 600 along water.

Figure 25:
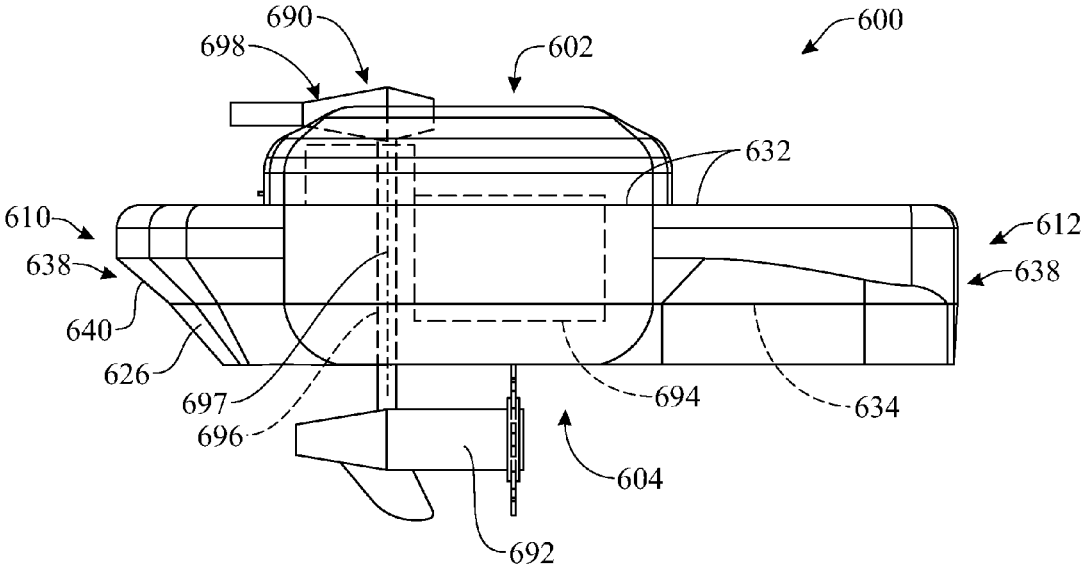
FIG. 25 presents a left side elevation view of the floatation device of FIG. 24.

The propulsion unit 690 of the present embodiment further includes a user-operable controller 698 in electrical communication with the propeller 692. The controller 698 of the present embodiment is arranged general on the upper surface 632 of the central body 630 and attached to the central body 630 by lateral fasteners 700; however, alternative embodiments are contemplated in which the controller 698 can be at least partially embedded in the main body, preferably in the central body 630 and more preferably in a central region of the central body 630. As shown in FIG. 25, the propeller unit connecting rod 696 can extend generally from the user-operable controller 698 to the propeller 692. The controller 698 can include a starter and a propeller speed control unit, either one of which can be operated by a user in order to start the propeller and adjust the propeller operating speed. The propulsion unit 690 can further comprise a user-operable interface for starting, stopping and/or adjusting the speed of the propeller 692. It is contemplated that the user-operable interface can be tactile, voice commanded, or other. For instance, the user-operable interface of the present embodiment is comprised of a set of useroperable controls or buttons 702 on the upper surface 632 of the central body 630, which can be selectively operated by the user's hand or foot. Alternative embodiments are contemplated in which the position of the user-operable controls or buttons may vary. For instance, the useroperable controls or buttons can be arranged on any one of the top left canted surface 652 and the top right canted surface 672.

Similarly to the embodiment of FIG. 7, the propeller 692 of the present embodiment can optionally be replaced by a non-propelling weight, the propeller 692 and the weight being interchangeably mountable to the central body 630. For instance and without limitation, the nonpropelling weight can be a capsule containing sand, rocks or the like.

Though not shown in the figures, the flotation device 600 of FIGS. 22 to 25 can further include elements shown in the previous embodiments such as, without limitation, a tether assembly configured to attach to a user's ankle or other body part. In some embodiments, the propulsion unit 690 can be operatively connected to the tether assembly in such a way that, upon a pulling of the tether assembly with a force higher than a predetermined threshold, the propulsion unit 690 responsively stops the propeller 692. In some embodiments, a proximal end of the tether assembly can operate a switch which in turn operates the controller 698 or propeller 692 to stop the propeller 692. In other embodiments, a proximal end of the tether assembly can operate a switch which interrupts electrical connection between the battery or batteries and the controller 698 and/or the propeller 692.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

The invention claimed is:

1. A buoyant recreational water flotation device, comprising:

a central body having a front end, a rear end, an upper surface, a bottom surface, and a longitudinal axis extending from the front end to the rear end;

a first foot support pad coupled to the central body and a second foot support pad coupled to the central body, wherein the first foot support pad and the second foot support pad are disposed on opposite lateral sides of the longitudinal axis, wherein each foot support pad is configured to support a foot of a user of the flotation device; and a propulsion unit attached to the central body and positioned between the first foot support pad and the second foot support pad in top view a first lateral element extending laterally from a first lateral side of the central body;

a second lateral element extending laterally from a second lateral side of the central body;

wherein the first lateral element and the second lateral element are disposed on opposite sides of the longitudinal axis;

wherein the first lateral element includes the first foot support pad and the second lateral element includes the second foot support pad;

wherein the device has a length measured from the front end to the rear end in top view and a width measured from the first lateral end to the second lateral end in top view, wherein the width of the device is greater than the length of the device.

2. The device of claim 1, wherein the first foot support pad comprises a canted surface that slopes downwardly moving toward the longitudinal axis of the central body, and wherein the second foot support pad comprises a canted surface that slopes downwardly moving toward the central axis.

3. The device of claim 1, wherein the central body includes a receptacle extending upwardly from the bottom surface; and wherein the propulsion unit is seated in the receptacle.

4. The device of claim 1, wherein the propulsion unit includes a propeller and a battery assembly configured to power the propeller;

wherein the battery assembly is directly attached to the central body between the first foot support pad and the second foot support pad.

5. The device of claim 4, wherein the battery assembly is mounted in a cavity extending upwardly from the bottom surface of the central body.

6. The device of claim 5, wherein the cavity extends from the bottom surface of the central body to the top surface of the central body.

7. The device of claim 1, wherein each lateral element has a top surface and a bottom surface;

wherein the central body has a thickness measured vertically from the bottom surface of the central body to the top surface of the central body;

wherein the left lateral element has a thickness measured vertically from the bottom surface of the left lateral element to the top surface of the left lateral element;

wherein the right lateral element has a thickness measured vertically from the bottom surface of the right lateral element to the top surface of the right lateral element;

wherein the thickness of the left lateral element is greater than the thickness of the central body; and wherein the thickness of the right lateral element is greater than the thickness of the central body.

8. A buoyant recreational water flotation device, comprising:

a central body having a front end, a rear end, an upper surface, a bottom surface, a left lateral side, a right lateral side, and a longitudinal axis extending from the front end to the rear end, wherein the longitudinal axis is positioned between the left lateral side and the right lateral side;

a left lateral element extending laterally from the left lateral side of the central body;

a right lateral element extending laterally from the right lateral side of the central body; and a left foot support pad disposed on an upper surface of the left lateral element and a right foot support pad disposed on an upper surface of the right lateral element, wherein the left footpad and the right footpad are each configured to support a foot of a user of the flotation device;

wherein the left lateral element defines an arcuate convex left peripheral edge of the device in top view and the right lateral element defines an arcuate convex right peripheral edge of the device in top view.

9. The device of claim 8, wherein each of the lateral foot pads comprises a canted surface, wherein each canted surface slopes downward moving towards the central body.

10. The device of claim 8, wherein the left lateral element defines a left peripheral edge of the device in top view and the right lateral element defines a right peripheral edge of the device in top view;

wherein the device has a length measured from the front end to the rear end in top view and a width measured from a left peripheral edge of the device to a right peripheral edge of the device in top view;

wherein the width of the device is greater than the length of the device.

11. The device of claim 8, wherein each lateral element has a top surface and a bottom surface;

wherein the central body has a thickness measured vertically from the bottom surface of the central body to the top surface of the central body;

wherein the left lateral element has a thickness measured vertically from the bottom surface of the left lateral element to the top surface of the left lateral element;

wherein the right lateral element has a thickness measured vertically from the bottom surface of the right lateral element to the top surface of the right lateral element;

wherein the thickness of the left lateral element is greater than the thickness of the central body; and wherein the thickness of the right lateral element is greater than the thickness of the central body.

12. The device of claim 8, wherein the central body includes a receptacle extending upwardly from the bottom surface, wherein the receptacle is positioned between the first foot support pad and the second foot support pad; and wherein the propulsion unit is at least partially seated in the receptacle.

13. The device of claim 12, wherein the propulsion unit includes a propeller and a battery assembly configured to power the propeller;

wherein the battery assembly is mounted to the central body in the cavity.

14. A buoyant recreational water flotation device, comprising:

a central body having a front end, a rear end, an upper surface, a bottom surface, a right lateral side, and a left lateral side opposite the right lateral side;

a left lateral element extending from the left lateral side of the central body;

a right lateral element extending from the right lateral side of the central body;

wherein each lateral element has a top surface and a bottom surface;

wherein the central body has a thickness measured vertically from the bottom surface of the central body to the top surface of the central body;

wherein the left lateral element has a thickness measured vertically from the bottom surface of the left lateral element to the top surface of the left lateral element;

wherein the right lateral element has a thickness measured vertically from the bottom surface of the right lateral element to the top surface of the right lateral element;

wherein the thickness of the left lateral element is greater than the thickness of the central body; and wherein the thickness of the right lateral element is greater than the thickness of the central body.

15. The device of claim 14, wherein the left lateral element defines a left peripheral edge of the device in top view and the right lateral element defines a right peripheral edge of the device in top view;

wherein the device has a length measured from the front end to the rear end in top view and a width measured from a left peripheral edge of the device to a right peripheral edge of the device in top view;

wherein the width of the device is greater than the length of the device.

16. The device of claim 14, wherein the central body includes a receptacle extending upwardly from the bottom surface, wherein the receptacle is positioned between the left lateral element and the right lateral element; and wherein the propulsion unit is seated in the receptacle.

17. The device of claim 16, wherein the propulsion unit includes a propeller and a battery assembly configured to power the propeller;

wherein the battery assembly of the propulsion unit is mounted to the central body in the receptacle.

* * * * *